US008297294B2

(12) United States Patent
Li

(10) Patent No.: US 8,297,294 B2
(45) Date of Patent: Oct. 30, 2012

(54) RECHARGEABLE BATTERY ARRANGEMENT FOR ELECTRICAL SYSTEM OF OUTDOOR SHADING DEVICE

(75) Inventor: Wanda Ying Li, Irvine, CA (US)

(73) Assignee: Oliver Joen-An Ma, Arcadia, CA (US)

( * ) Notice: Subject to any disclaimer, the term of this patent is extended or adjusted under 35 U.S.C. 154(b) by 186 days.

(21) Appl. No.: 12/804,491

(22) Filed: Jul. 21, 2010

(65) Prior Publication Data

US 2010/0307547 A1 Dec. 9, 2010

Related U.S. Application Data

(63) Continuation-in-part of application No. 11/985,415, filed on Nov. 14, 2007, now Pat. No. 8,015,988.

(51) Int. Cl.
*A45B 3/02* (2006.01)
*A45B 23/00* (2006.01)

(52) U.S. Cl. ..... 135/16; 135/98; 135/20.3; 135/910; 362/102; 379/454; 248/316.4

(58) Field of Classification Search ..... 135/16, 135/20.3, 21, 98, 910, 155, 20.1; 362/102, 362/431; 224/929, 483, 570, 558; 248/231.51, 248/231.85, 316.4; 379/446, 454, 455
See application file for complete search history.

(56) References Cited

U.S. PATENT DOCUMENTS

| | | | | |
|---|---|---|---|---|
| 6,612,713 | B1 * | 9/2003 | Kuelbs | 362/102 |
| 6,732,752 | B2 * | 5/2004 | Cohen et al. | 135/16 |
| 6,796,318 | B2 * | 9/2004 | Cohen et al. | 135/16 |
| 7,017,598 | B2 * | 3/2006 | Nipke | 135/16 |
| 7,111,954 | B1 * | 9/2006 | Lai | 362/102 |
| 7,125,133 | B2 * | 10/2006 | Bilotti et al. | 362/102 |
| 7,134,762 | B2 * | 11/2006 | Ma | 362/102 |
| 7,188,633 | B2 * | 3/2007 | Zerillo | 135/20.3 |
| 7,331,684 | B2 * | 2/2008 | Tung | 362/102 |
| 7,540,459 | B2 * | 6/2009 | Asano et al. | 248/309.1 |
| 2002/0078985 | A1 * | 6/2002 | Farr | 135/16 |
| 2009/0071516 | A1 * | 3/2009 | Li | 135/16 |

* cited by examiner

*Primary Examiner* — Winnie Yip
(74) *Attorney, Agent, or Firm* — Raymond Y. Chan; David and Raymond Patent Firm

(57) ABSTRACT

A rechargeable power source, which is detachably coupled with a shading device to electrically connect with an electrical arrangement thereof, includes a rechargeable battery unit having a battery terminal arranged to contact with the electrical terminal of the electrical arrangement, and a locking arrangement which contains a releasable locker to detachably couple the rechargeable battery unit with the shading device and to ensure the battery terminal being contact with an electrical terminal of the electrical arrangement so as to electrically connect the rechargeable battery unit with the electrical arrangement. Therefore, the electrical arrangement of the shading device is powered by the rechargeable battery unit to eliminate the power extension to the external power source.

10 Claims, 26 Drawing Sheets

A–A

B–B

C—C

RECHARGEABLE BATTERY ARRANGEMENT FOR ELECTRICAL SYSTEM OF OUTDOOR SHADING DEVICE

CROSS REFERENCE OF RELATED APPLICATION

This is a CIP application that claims the benefit of priority under 35 U.S.C. §119 to a non-provisional application, application Ser. No. 11/985,415, filed Nov. 14, 2007 now U.S. Pat. No. 8,015,988.

BACKGROUND OF THE PRESENT INVENTION

1. Field of Invention

The present invention relates to a shading device, and more particularly to a shading device, such as an outdoor umbrella, with rechargeable battery arrangement which is detachably mounted to the structure of the shading device to electrically connect with an electrical arrangement thereof so as to provide electrical energy to electrical arrangement, such as an audio/video system or an illumination system.

2. Description of Related Arts

Foldable outdoor umbrellas are usually set up in outdoor area, such as the patio area, garden area, campground or beach area, to provide a shade for the users to avoid excessive exposure of vigorous sunlight. A conventional outdoor umbrella generally comprises a stand having a predetermined weight, a supporting stem upwardly extending from the stand and a foldable awning supported by the supporting frame to provide a shading area under the foldable awning.

While enjoying the shading area during the daytime, people may need some entertainment equipment such as stereo or other electronic devices to listen to the music, watch videos or play video games, and the power source is a problem under the circumstances. Furthermore, in the nighttime, a lighting fixture is necessary for outdoor illumination and the power source becomes a more serious problem than that during the daytime. In other words, the outdoor umbrellas, as the name implies, are designed for use in outdoors, existence of an electrical power source cannot be guaranteed. Also, it is inconvenient and impractical for the user to extend an electrical cord from the dwelling to the patio or garden area, much less the campground or beach area.

Some outdoor umbrellas have a solar energy arrangement which can convert the solar energy to electrical energy which can be used for either the lighting fixture or electronic devices. Even though the solar energy arrangement is convenient and environmentally friendly, it may not provide sufficient energy during the nighttime without sunlight or when there is not enough sunlight, and the lighting fixture or electronic devices may not under their best working condition without sufficient electrical energy. Also, the solar energy arrangement may somewhat decrease the aesthetic value of the outdoor umbrella.

Notwithstanding these developments, conventional shading devices, even with some sophisticated improvements, such as the lighting system and the speaker of the sound system, are usually not responsive enough to the change of environmental circumstances in which the shading devices operate. This discrepancy may be partially resolved by manual operation of the shading devices. For example, a user may easily turn on or turn off the illumination system whenever necessary. In some situations, however, frequent manual operation of the shading system may mean inconvenience and interruption of a scheduled activity in the shading system.

Therefore, a control panel may further be adapted for centrally and electrically control one or more electronic appliances incorporated with the outdoor shading device, such that the user is able to conveniently and adjustably control the electronic appliance through the control panel. For instance, the user may adjust the volume of the speaker mounted on the frame of the outdoor shading device via the control panel.

On the other hand, along with the growth of personal portable electronic devices become more and more popular, there raise a great need for incorporating the electronic device with the functional entertaining system of the outer shading device, such as electrically connecting the iPod Touch to the speaker for playing music therein. Therefore, the present invention provides a controller unit having electronic appliance holder for incorporating the control panel and the electronic appliances including the personal portable electronic devices, so that the user is able to easily incorporating their own portable personal device of the electronic appliances with the outdoor shading device.

SUMMARY OF THE PRESENT INVENTION

The present invention is advantageous in that it provides a controller unit with at least an electronic appliance holder assembly for an outdoor shading device, so that a user is able to electrically connect portable electronic device of the electronic appliance with the controller unit to conveniently incorporate the electronic appliance with the outdoor shading device.

Another advantage of the present invention is to provide a controller unit with at least an electronic appliance holder assembly for an outdoor shading device, wherein the control panel has one or more connecting slots for electrically connecting with one or more electronic appliances therethrough, so as to incorporate the electronic appliance, such as the personal portable electronic device, with the outdoor shading device.

Another advantage of the present invention is to provide a controller unit with at least an electronic appliance holder assembly for an outdoor shading device, wherein the control panel of the controller unit and the electronic appliance holder is located at two opposed sides of the supporting case, so that the electronic appliance being held on the holder is able to conveniently and electrically link with the control panel, so as to integral the electronic appliances with the outdoor shading device.

Another advantage of the present invention is to provide a controller unit with at least an electronic appliance holder assembly for an outdoor shading device, wherein the supporting case is able to coaxially coupling with the supporting frame to form a compacted and integrated controller unit and the electronic appliance holder thereat.

Another advantage of the present invention is to provide a controller unit with at least an electronic appliance holder assembly for an outdoor shading device, wherein the holder is able to be rotatably adjusted to a predetermined angle, so as for conveniently viewing or controlling the electronic appliance being held thereat.

Another advantage of the present invention is to provide a controller unit with at least an electronic appliance holder assembly for an outdoor shading device, wherein the control panel of the controller unit is detachably mounted on the supporting case, so that the control panel is able to be detached for being used as a remote controller.

Another object of the present invention is to provide a rechargeable battery arrangement for a shading device, wherein the rechargeable battery arrangement is detachably mounted to the structure of the shading device to electrically connect with an electrical arrangement thereof so as to provide electrical energy to electrical arrangement, such as an audio/video system or an illumination system.

Another advantage of the present invention is to provide a rechargeable battery arrangement for an outdoor shading device, wherein the detachably holder assembly and/or the controller unit is able to interchange with the detachable and rechargeable battery, so that the user is able to detachably assemble variety of combinations between the controller unit, the holder assembly, and/or the rechargeable battery.

Another object of the present invention is to provide a rechargeable battery arrangement for a shading device, wherein the electrical arrangement is coupled with the awning frame and an electrical terminal is extended from the electrical device to the supporting shaft in a pre-wiring manner. Therefore, the user is able to attach the rechargeable battery arrangement to the shading device to direct connect with the electrical arrangement of the shading device.

Another object of the present invention is to provide a rechargeable battery arrangement for a shading device, wherein the rechargeable battery arrangement is detachably mounted on an operation housing of the shading device, wherein the battery unit can be conveniently detached and recharged by using an external electrical power source.

Another object of the present invention is to provide a rechargeable battery arrangement for a shading device, wherein the battery unit of the rechargeable battery arrangement can be disengaged from the supporting shaft by pressing a releasing button located on the operation housing. Therefore, the user is able to easily and quickly operate the attaching/detaching operation of the rechargeable battery arrangement.

Another object of the present invention is to provide a rechargeable battery arrangement for a shading device, wherein the battery unit of the rechargeable battery arrangement can be disengaged from the supporting shaft by pressing &releasing button located on the battery unit.

Another object of the present invention is to provide a rechargeable battery arrangement for a shading device, wherein the battery unit of the rechargeable battery arrangement can be disengaged from the supporting shaft by sliding a releasing button towards one direction.

Another object of the present invention is to provide a rechargeable battery arrangement for a shading device, wherein the battery unit of the rechargeable battery arrangement can be mounted on the supporting shaft by a plurality of mounting screws.

Another object of the present invention is to provide a rechargeable battery arrangement for a shading device, which does not require altering the original structural configuration of the shading device so as to reduce the manufacturing cost of the shading device incorporating with the rechargeable battery arrangement.

Another object of the present invention is to provide a rechargeable battery arrangement for a shading device, wherein no expensive or mechanical structure is required to employ in the present invention in order to achieve the above mentioned objects. Therefore, the present invention successfully provides an economic and efficient solution not only for providing a simple electrical configuration of the outdoor umbrella but also for enhancing the practice use of the shading device.

According to the present invention, the foregoing and other objects and advantages are attained by providing a controller unit for electrically controlling an outdoor shading device having an awning frame and a supporting frame, which comprises:

a supporting case mounted on the supporting frame of the outdoor shading device, wherein the supporting case has a surrounding wall;

a control panel being supported on the surrounding wall of the supporting case at a predetermined location for controlling one or more electronic appliances of the outdoor shading device; and an electronic appliance holder assembly for holding at least an electronic appliance thereat and electrically linking with the control panel, wherein the holder assembly is located on the surrounding wall of the supporting case and being arranged that the electronic appliance holder assembly is located at an opposed side of the surrounding wall with respective to the control panel.

In accordance with another aspect of the invention, the present invention comprises an outdoor shading device, which comprises:

a supporting frame;

an awning frame movably supported by the supporting frame to define a shading area under the awning frame; and a controller unit, comprising:

a supporting case mounted on the supporting frame of the outdoor shading device, wherein the supporting case has a surrounding wall;

a control panel being supported on the surrounding wall of the supporting case at a predetermined location for controlling one or more electronic appliances of the outdoor shading device; and an electronic appliance holder assembly for holding at least an electronic appliance thereat and electrically linking with the control panel, wherein the holder assembly is located on the surrounding wall of the supporting case and being arranged that the electronic appliance holder assembly is located at an opposed side of the surrounding wall with respective to the control panel.

Accordingly, in order to accomplish the above objects, the present invention provides a shading device, which comprises an awning, a frame, an electrical arrangement, and a rechargeable power source.

The frame comprises a supporting shaft and an awning frame suspendedly supported by the supporting shaft and coupled with the awning for defining a shading area thereunder.

The electrical arrangement is supported at the frame for providing an additional shading function, wherein the electrical arrangement comprises an electrical device coupled with the awning frame and an electrical terminal extended from the electrical device to the supporting shaft in a pre-wiring manner.

The rechargeable power source comprises:

a rechargeable battery unit having a power outlet for electrically connecting with an external power source in charging manner, and a battery terminal arranged to contact with the electrical terminal of said electrical arrangement; and a locking arrangement which contains a releasable locker to detachably couple the rechargeable battery unit with the frame at a hand reachable distance and to ensure the battery terminal being contact with the electrical terminal so as to electrically connect the rechargeable battery unit with the electrical arrangement.

These and other objectives, features, and advantages of the present invention will become apparent from the following detailed description, the accompanying drawings, and the appended claims.

DETAILED DESCRIPTION OF THE PREFERRED EMBODIMENT

Figure 1:
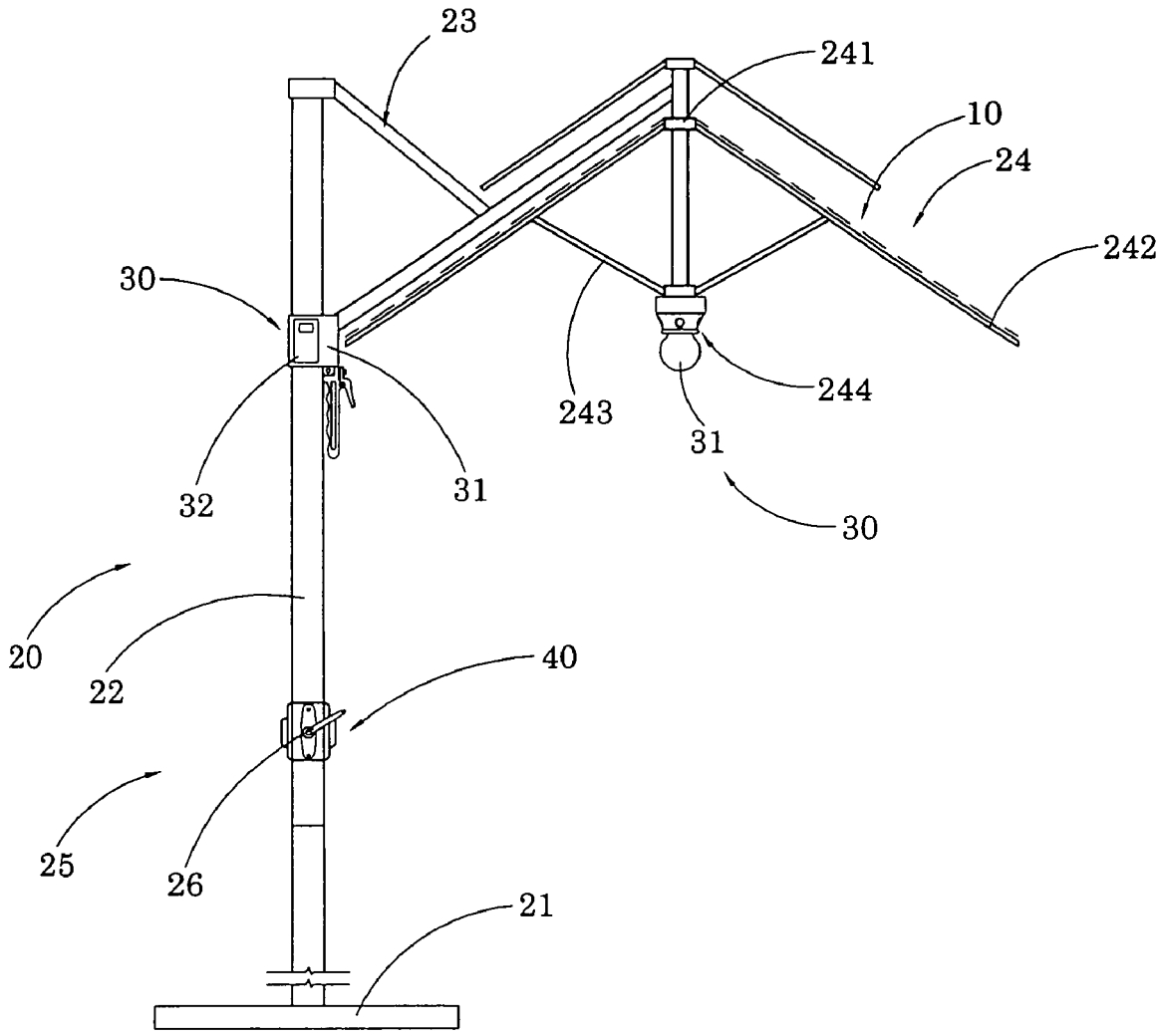
FIG. 1 is a schematic representation of an outdoor umbrella incorporating with the rechargeable battery arrangement according to the preferred embodiment of the present invention.

Referring to FIG. 1 of the drawings, a shading device according to a first preferred embodiment of the present invention is illustrated. According to the first preferred embodiment, the shading device comprises an awning supported by an awning supporting structure to provide a shading area under the awning. For example, the shading device, which is embodied as an outdoor umbrella, comprises an umbrella awning 10, an umbrella frame 20 which supports the umbrella awning 10, an electrical arrangement 30 supported at the umbrella frame 20, and a rechargeable power source 40 which provides electrical power to the electrical arrangement 30 to be operated without using an electrical cord.

The umbrella frame 20 comprises a base 21, a supporting shaft 22 vertically mounted on top of the base 21, a connecting arm 23 sidewardly extended from a top portion of the supporting shaft 22 in a pivotally movable manner, and a foldable awning frame 24 suspendedly supported by the supporting shaft 22 and coupled with the umbrella awning 10 to define the shading area under the umbrella awning 10.

As shown in FIG. 1 and FIG. 2, the umbrella frame 20 further comprises an operation housing 25 mounted at the supporting shaft 22, an operational unit 26 and a battery compartment 27, wherein the operation unit 26 is adapted for selectively operating the awning frame 24 at an unfolded position and a folded position. The battery compartment 27 is provided at a sidewall of the operation housing 25 to receive a battery unit 41 illustrated below.

The awning frame 24 comprises an upper housing 241 and a plurality of awning supporting arms 242 outwardly and radially extended from the upper housing 241 in such a manner that they are adapted to move between a folded position and an unfolded position, wherein in the folded position, the awning supporting arms 242 are pivotally and inwardly folded to overlappedly lay in position, wherein in the unfolded position, the awning supporting arms 242 are pivotally and outwardly extended to support the umbrella awning 10 thereon and to define a shading area under the awning supporting arms 242. The awning frame 24 further comprises a plurality of lower connecting bars 243 each having a first end slidably mounted on the awning supporting arms 242, and a second end mounted on a lower housing 244 provided below the upper housing 241.

The electrical arrangement 30 comprises at least one electrical device 31 such as a music player, a movie player or a lighting fixture, supported at the umbrella frame 20 to provide an additional umbrella function, wherein the electrical device 31 is coupled with the awning frame 24 and an electrical terminal 32 extended from the electrical device 31 to the supporting shaft 22 in a pre-wiring manner.

Figure 2A:
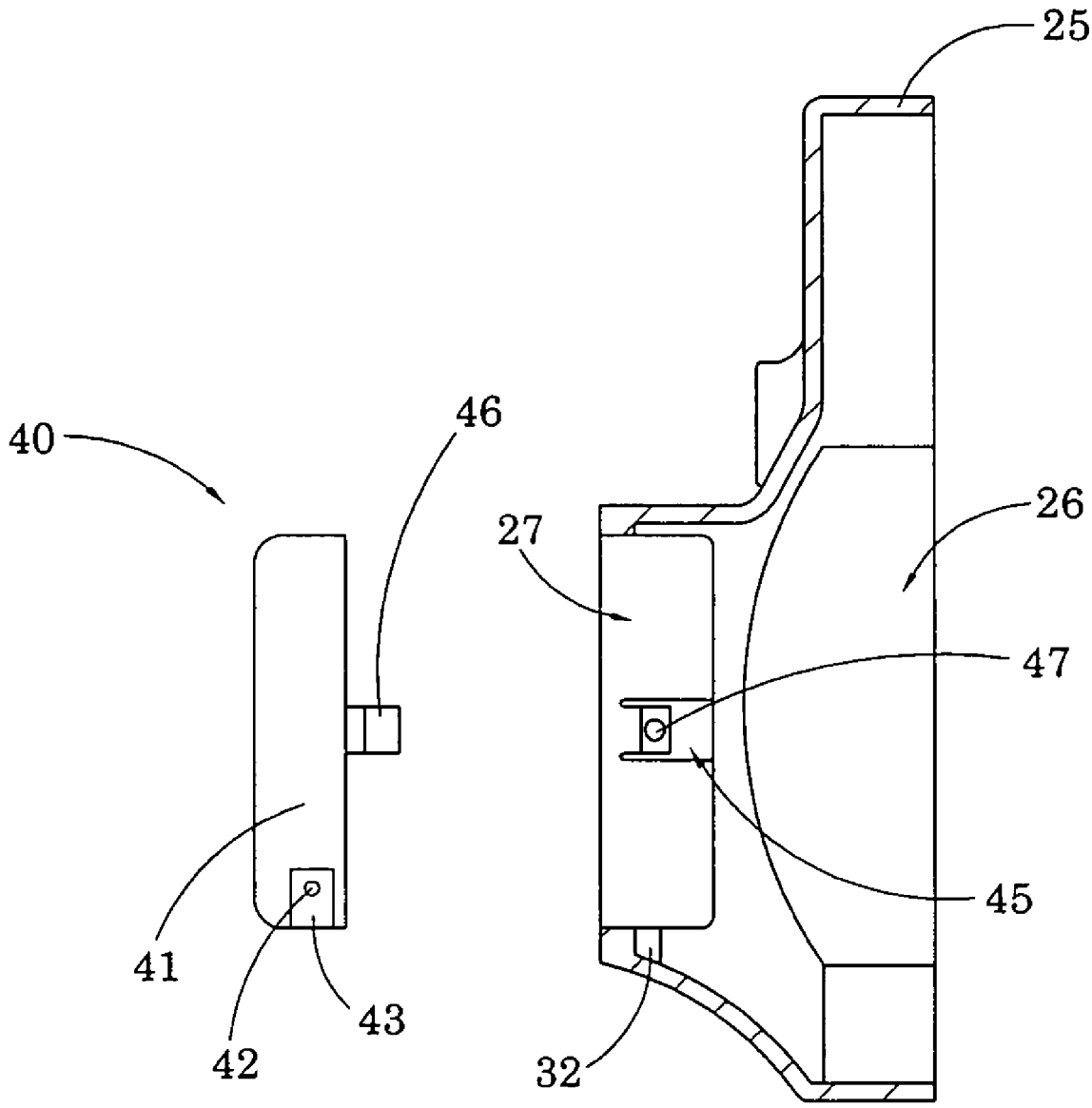
FIG. 2A is a schematic representation of the rechargeable battery arrangement of the outdoor umbrella according to the above preferred embodiment of the present invention, wherein the releasing button is located at an operation housing.
Figure 2B:
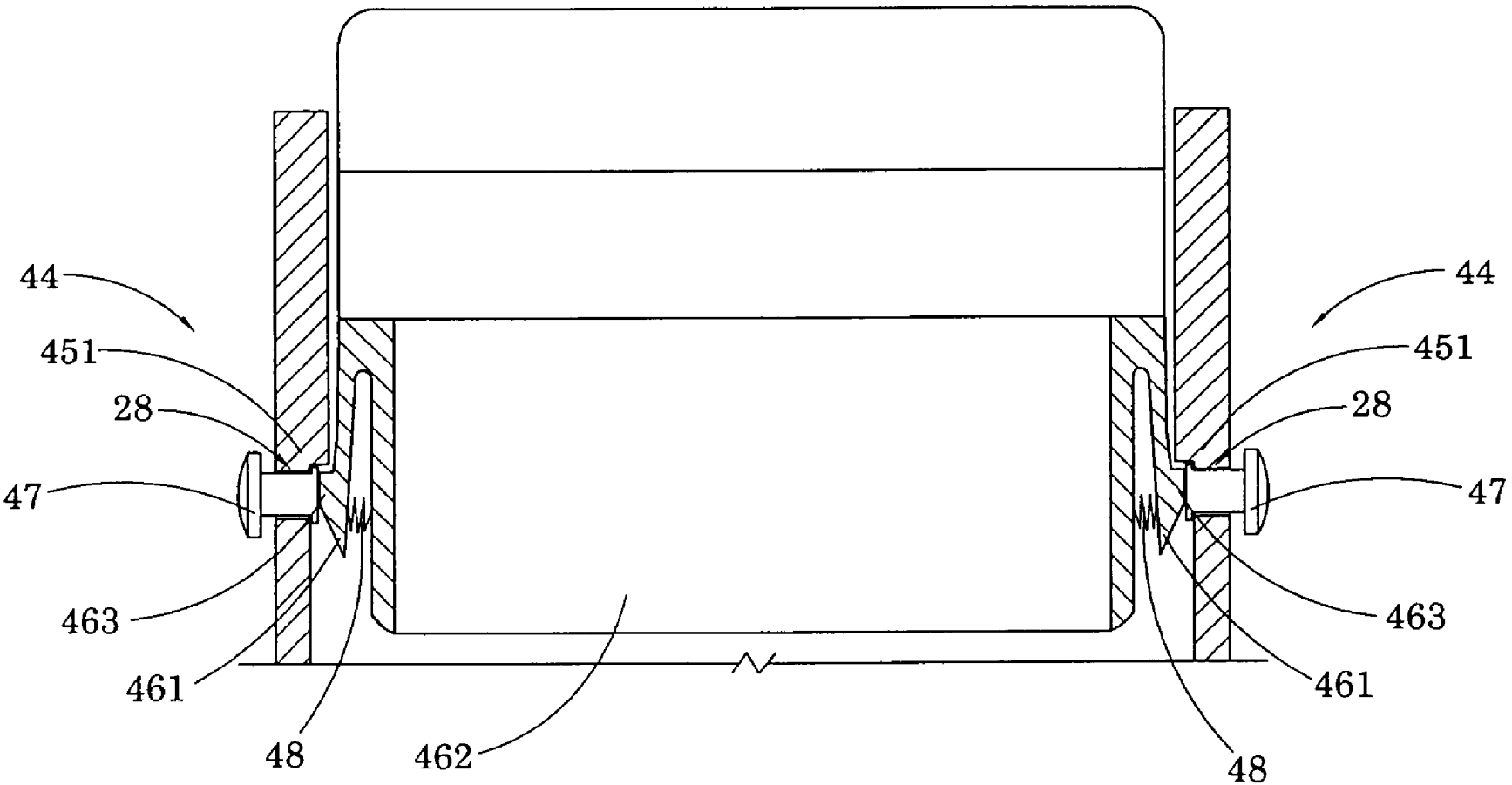
FIG. 2B is sectional view of the rechargeable battery arrangement of the outdoor umbrella according to the above preferred embodiment of the present invention.

As shown in FIG. 2A and FIG. 2B, the rechargeable power source 40 comprises a rechargeable battery unit 41 having a power outlet 42 for electrically connecting with an external power source in charging manner, and a battery terminal 43 arranged to contact with the electrical terminal 32 of the electrical arrangement 30. The rechargeable power source 40 also includes a locking arrangement 44 for retaining the rechargeable battery unit 41 at the umbrella frame 20. The locking arrangement 44 comprises a locker slot 45 provided at the umbrella frame 20 and a releasable locker 46 extended from the rechargeable battery unit 41 to detachably couple the rechargeable battery unit 41 with the supporting shaft 22 and to ensure the battery terminal 43 being contact with the electrical terminal 32 so as to electrically connect the rechargeable battery unit 41 with the electrical arrangement 30. Accordingly, the rechargeable battery unit 41 is detachably mounted at the umbrella frame 20 with a hand reachable distance such that when the user locates within the shading area of the umbrella frame 20, the user is able to reach the rechargeable battery unit 41 to attach to or detach from the umbrella frame 20.

It is worth to mention that two rechargeable power sources 40 can be detachably mounted to two sides of the operation housing 25 respectively to double the power supply for the electrical arrangement 30. In other words, two battery compartments 27 are provided at two side of the operation housing 25 to receive two rechargeable power sources 40 respectively.

Accordingly, the locker slot 45 and the electrical terminal 32 are provided at a base wall and a bottom wall of the battery compartment 27 to slidably engage with the releasable locker 46 and to electrically contact with the battery terminal 43 respectively when the rechargeable battery unit 41 is received in the battery compartment 43. In other words, the rechargeable battery unit 41 of the rechargeable power source 40 is detachably mounted at the supporting shaft 22 of the outdoor umbrella. Therefore, by detachably mounting the rechargeable battery unit 41 at the operation housing 25 mounted along the supporting shaft 22, the user is able to reach the rechargeable battery unit 41 and operate the folding/unfolding operation of the umbrella awning 10.

The releasable locker 46 comprises two spaced apart resilient arms 461 and a locking tongue 462, wherein each of the resilient arms 461 has a hooking end 463 formed at a free end thereof. The locker slot 45 has two locking protrusions 451 provided at two sidewalls of the locker slot 45, wherein the hooking ends 463 of the resilient arms 461 are engaged with the locking protrusions 451 when the releasable locker 46 is slid into the locker slot 45. Accordingly, the locking tongue 462 is slidably inserted into the locker slot 45, wherein the resilient arms 461 are spacedly extended at two sidewalls of the locking tongue 462 to define a resilient gap between each of the resilient arms 461 and the corresponding sidewall of the locking tongue 462. Each of the resilient gaps allows the respective resilient arm 461 to be slightly bent to engage with the respective locking protrusion 451 when the releasable locker 46 is slid into the locker slot 45.

In the preferred embodiment as shown in FIG. 2B, in order to disengage the rechargeable battery unit 41 from the supporting shaft 22, the locking arrangement 44 comprises two releasing buttons 47 located at corresponding actuation slots 28 on the umbrella frame 20. The releasing buttons 47 are arranged for releasing the releasable locker 46 from the locker slot 45, wherein each of the releasing buttons 47 has a pushing end aligned with the respective resilient arm 461 and an opposed pressing end arranged in such a manner that when the pressing ends of the releasing buttons 47 are pressed, the pushing ends of the releasing buttons 47 push at the resilient arms 461 towards the resilient gaps so as to disengage the hooking ends 463 of the resilient arms 461 with the locking protrusions 451 respectively.

Accordingly, the releasing buttons 47 are slidably mounted at the sidewalls of the locker slot 45 respectively at a position that the pushing ends of the releasing buttons 47 are align with the hooking ends 463 of the resilient arms 461 respectively, such that when the pressing ends of the releasing buttons 47 are pressed, the resilient arms 461 are driven to move at the resilient gaps to disengage with the locking protrusions 451 respectively. In particularly, the releasing button 47 is movably mounted to the sidewalls of the locker slot 45 through the actuation slots 28, wherein each of the actuation slots 28 is aligned with the hooking end 463 of the resilient arm 461 such that when the releasing button 47 is pressed towards the hooking end 463, the hooking end 463 is pushed away from the locking protrusion 451 to disengage the locking structure.

In addition, the locking arrangement 44 further comprises two resilient elements 48 supported within the resilient gaps respectively, wherein each of the resilient elements 48 has two ends biasing against the respective resilient arm 461 and the sidewall of the locking tongue 462 for applying an urging force against the resilient arm 461. Each of the resilient elements 48 is a compression spring for providing an additional resilient force to the respective resilient arm 461 and the respective releasing button 47 as well. In other words, the releasing button 47 is coupled with the resilient element 48 via the respective resilient arm 461, such that the releasing button 47 can be restored to its original position after being pressed towards the hooking end 463.

When the rechargeable battery unit 41 is charged and connected with the electrical arrangement 30, the electrical power to operate the electrical device 31 is provided by the rechargeable battery unit 41. In other words, the user can play music or movie through the player pre-wired to the supporting shaft 22 outside the dwelling and under the shading area defined by the umbrella awning 10 without using the electrical cord. During the nighttime, the user can further enjoy the music or movie under the outdoor umbrella 10 by lighting up the lighting fixture to which the electrical power is also provided by the rechargeable battery unit 41.

Figure 3A:
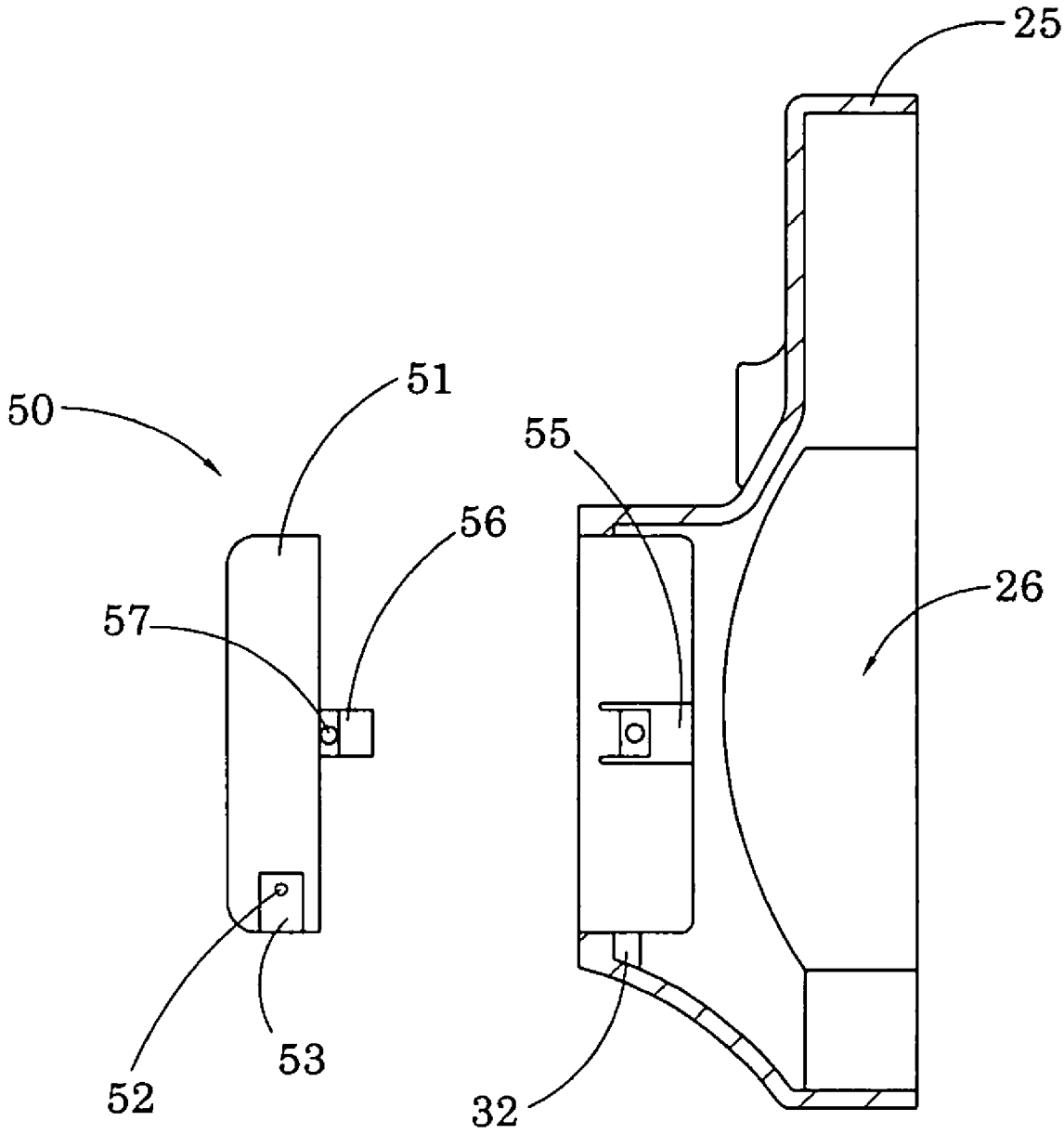
FIGS. 3A and 3B illustrate a first alternative mode of the locking arrangement according to the above preferred embodiment of the present invention, wherein the releasing button is located at a rechargeable battery unit.
Figure 3B:
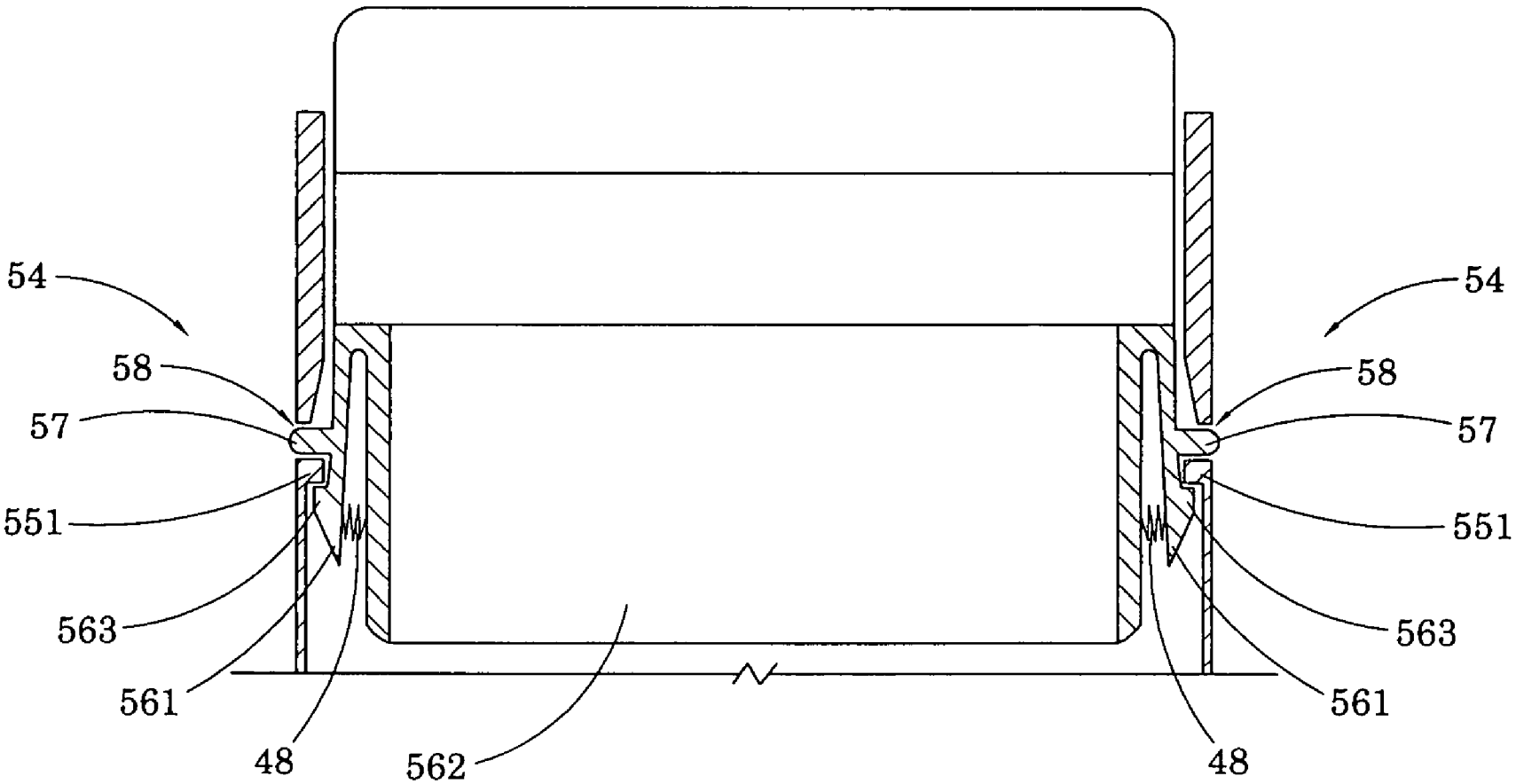

Referring to FIG. 3A and FIG. 3B of the drawings, a first alternative of the rechargeable power source 50 is illustrated. The rechargeable power source 50 comprises a rechargeable battery unit 51 having a power outlet 52 for electrically connecting with an external power source in charging manner, and a battery terminal 53 arranged to contact with the electrical terminal 32 of the electrical arrangement 30. The rechargeable power source 50 also includes a locking arrangement 54 which comprises a locker slot 55 provided at the supporting shaft 22 and a releasable locker 56 extended from the rechargeable battery unit 51 to detachably couple the rechargeable battery unit 51 with the supporting shaft 22 and to ensure the battery terminal 53 being contact with the electrical terminal 32 so as to electrically connect the rechargeable battery unit 51 with the electrical arrangement 30.

Accordingly, the locker slot 55 and the electrical terminal 32 are provided at a base wall and a bottom wall of the battery compartment 27 to slidably engage with the releasable locker 56 and to electrically contact with the battery terminal 53 respectively when the rechargeable battery unit 51 is received in the battery compartment 53.

The releasable locker 56 comprises two spaced apart resilient arms 561 and a locking tongue 562, wherein each of the resilient arms 561 has a hooking end 563 formed at a free end thereof. The locker slot 55 has two locking protrusions 551 provided at two sidewalls of the locker slot 55, wherein the hooking ends 563 of the resilient arms 561 are engaged with the locking protrusions 551 when the releasable locker 56 is slid into the locker slot 55. Accordingly, the locking tongue 562 is slidably inserted into the locker slot 55, wherein the resilient arms 561 are spacedly extended at two sidewalls of the locking tongue 562 to define a resilient gap between each of the resilient arms 561 and the corresponding sidewall of the locking tongue 562. Each of the resilient gaps allows the respective resilient arm 561 to be slightly bent to engage with the respective locking protrusion 551 when the releasable locker 56 is slid into the locker slot 55.

As shown in FIG. 3B, in order to disengage the rechargeable battery unit 51 from the supporting shaft 22, the locking arrangement 54 comprises two releasing buttons 57 aligned with corresponding actuation slots 59 on the umbrella frame 20. The releasing buttons 57 are arranged for releasing the releasable locker 56 from the locker slot 55, wherein each of the releasing buttons 57 has a pushing end aligned with the respective resilient arm 561 and an opposed pressing end arranged in such a manner that when the pressing ends of the releasing buttons 57 are pressed, the pushing ends of the releasing buttons 57 push at the resilient arms 561 towards the resilient gaps so as to disengage the hooking ends 563 of the resilient arms 561 with the locking protrusions 551 respectively.

Accordingly, the pushing ends of the two releasing buttons 57 are sidewardly and integrally extended at the resilient arms 561 respectively such that when the pressing ends of the releasing buttons 57 are pressed, the resilient arms 561 are driven to move at the resilient gaps to disengage with the locking protrusions 551 respectively.

The two actuation slots 59 are formed at the sidewalls of the locker slot 55 respectively, wherein the pressing ends of the releasing buttons 57 are protruded out of the locker slot 55 through the actuation slots 59 respectively when the releasable locker 56 is locked at the locker slot 55. Therefore, when the releasable locker 56 is slidably inserted into the locker slot 55, the pressing ends of the releasing buttons 57 slide at the sidewalls of the locker slot 55 until the pressing ends of the releasing buttons 57 are located at the actuation slots 59 respectively, so as to ensure the hooking ends 563 of the resilient arms 561 engaging with the locking protrusions 551.

The locking arrangement 54 further comprises two resilient elements 58 supported within the resilient gaps respectively, wherein each of the resilient elements 58 has two ends biasing against the respective resilient arm 561 and the sidewall of the locking tongue 562 for applying an urging force against the resilient arm 561. Each of the resilient elements 58 is a compression spring for providing an additional resilient force to the respective resilient arm 561 and the respective releasing button 57 as well. In other words, the releasing button 57 is coupled with the resilient element 58 via the respective resilient arm 561, such that the releasing button 57 can be restored to its original position after being pressed towards the hooking end 563.

Figure 4A:
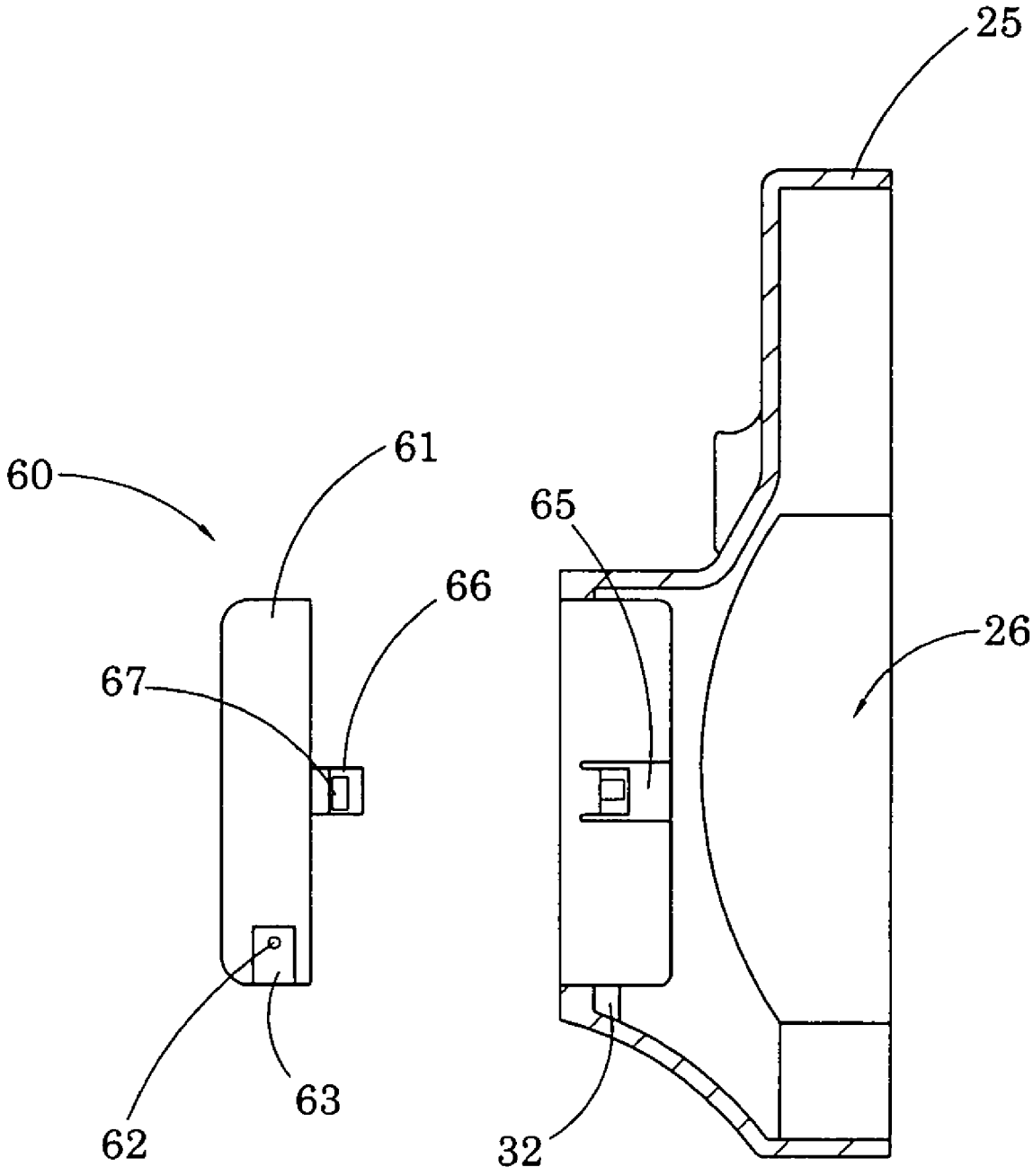
FIGS. 4A and 4B illustrate a second alternative mode of the locking arrangement according to the above preferred embodiment of the present invention, wherein the releasing button is located at the rechargeable battery unit in a slidable manner.
Figure 4B:
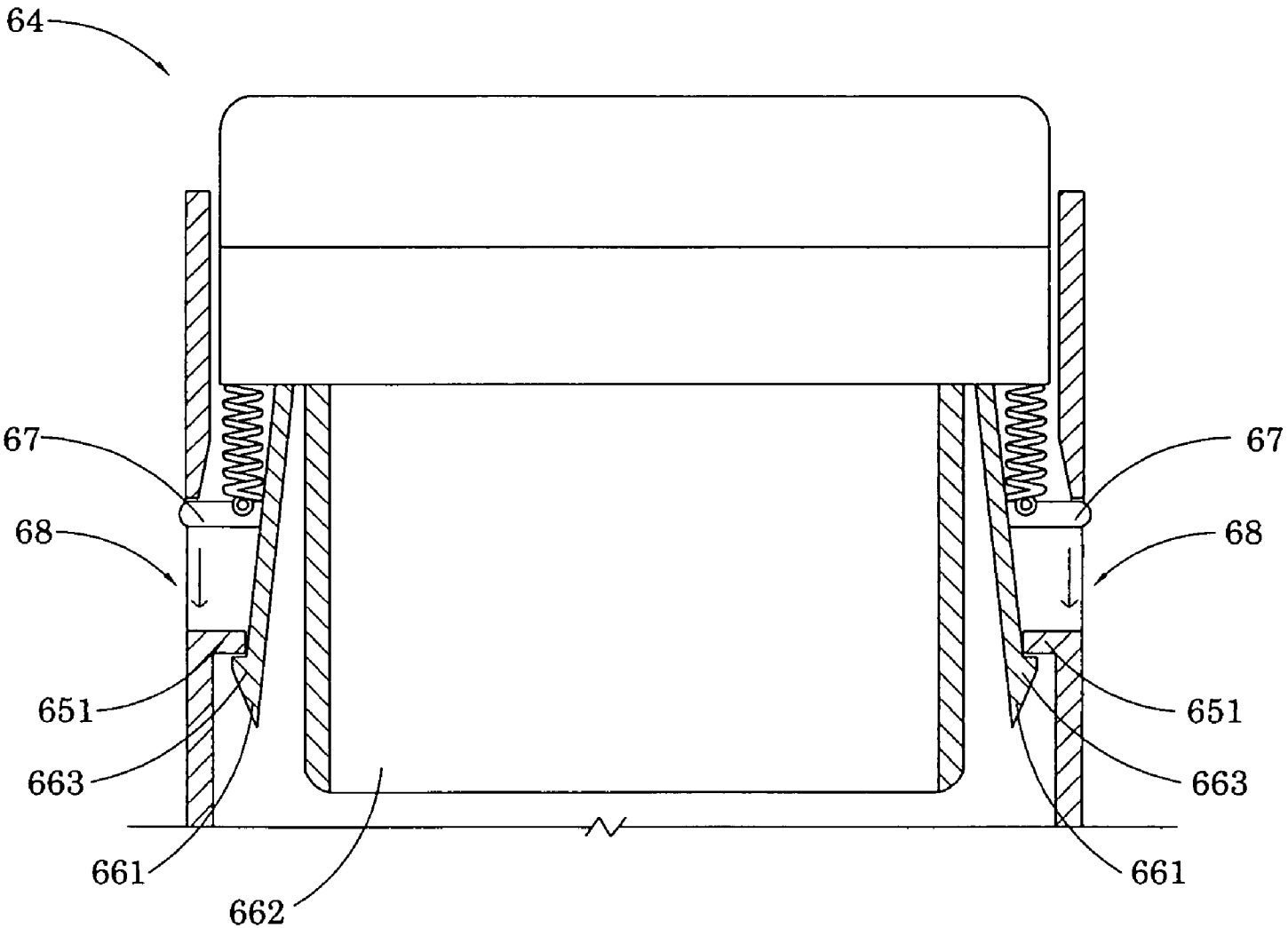

Referring to FIG. 4A and FIG. 4B of the drawings, a second alternative of the rechargeable power source 60 is illustrated. The rechargeable power source 60 comprises a rechargeable battery unit 61 having a power outlet 62 for electrically connecting with an external power source in charging manner, and a battery terminal 63 arranged to contact with the electrical terminal 32 of the electrical arrangement 30. The rechargeable power source 60 also includes a locking arrangement 64 which comprises a locker slot 65 provided at the supporting shaft 22 and a releasable locker 66 extended from the rechargeable battery unit 61 to detachably couple the rechargeable battery unit 61 with the supporting shaft 22 and to ensure the battery terminal 63 being contact with the electrical terminal 32 so as to electrically connect the rechargeable battery unit 61 with the electrical arrangement 30.

Accordingly, the locker slot 65 and the electrical terminal 62 are provided at a base wall and a bottom wall of the battery compartment 27 to slidably engage with the releasable locker 66 and to electrically contact with the battery terminal 63 respectively when the rechargeable battery unit 61 is received in the battery compartment 63.

The releasable locker 66 comprises two spaced apart resilient arms 661 and a locking tongue 662, wherein each of the resilient arms 661 has a hooking end 663 formed at a free end thereof. The locker slot 65 has two locking protrusions 651 provided at two sidewalls of the locker slot 65, wherein the hooking ends 663 of the resilient arms 661 are engaged with the locking protrusions 651 when the releasable locker 66 is slid into the locker slot 65. Accordingly, the locking tongue 662 is slidably inserted into the locker slot 65, wherein the resilient arms 661 are spacedly extended at two sidewalls of the locking tongue 662 to define a resilient gap between each of the resilient arms 661 and the corresponding sidewall of the locking tongue 662. Each of the resilient gaps allows the respective resilient arm 661 to be slightly bent to engage with the respective locking protrusion 651 when the releasable locker 66 is slid into the locker slot 65.

As shown in FIG. 4B, in order to disengage the rechargeable battery unit 61 from the supporting shaft 22, the locking arrangement 64 comprises two releasing buttons 67 aligned with corresponding actuation slots 69 on the umbrella frame 20. The releasing buttons 67 are arranged for releasing the releasable locker 66 from the locker slot 65, wherein each of the releasing buttons 67 has a pushing end aligned with the respective resilient arm 661 and an opposed pressing end arranged in such a manner that when the pressing ends of the releasing buttons 67 are pressed, the pushing ends of the releasing buttons 67 push at the resilient arms 661 towards the resilient gaps so as to disengage the hooking ends 663 of the resilient arms 661 with the locking protrusions 651 respectively.

Accordingly, the pushing ends of the two releasing buttons 67 are slidably mounted at the resilient arms 661 respectively such that when the pressing ends of the releasing buttons 67 are pressed to slide along the resilient arms 661 respectively, the resilient arms 661 are driven to move at the resilient gaps to disengage with the locking protrusions 651 respectively. In other words, when the releasing buttons 67 are pressed and slid towards the hooking ends 663 of the resilient arms 661 respectively, the hooking ends 663 of the resilient arms 661 are pressed towards the resilient gaps to disengage with the locking protrusions 651 respectively.

The two actuation slots 69 are formed at the sidewalls of the locker slot 65 respectively, wherein the pressing ends of the releasing buttons 67 are protruded out of the locker slot 65 through the actuation slots 69 respectively when the releasable locker 66 is locked at the locker slot 65. Therefore, when the releasable locker 66 is slidably inserted into the locker slot 65, the pressing ends of the releasing buttons 67 slide at the sidewalls of the locker slot 65 until the pressing ends of the releasing buttons 67 are located at the actuation slots 69 respectively, so as to ensure the hooking ends 663 of the resilient arms 661 engaging with the locking protrusions 651.

The locking arrangement 64 further comprises two resilient elements 68 coupled with the releasing buttons 67 to slidably pull the releasing buttons 67 away from the hooking end 663 of the resilient arms 661. Each of the resilient elements 68 has two ends coupling with the base wall of the releasable locker 66 and the releasing buttons 67 for applying a pulling force against the releasable locker 66 such that the releasing button 67 can be restored to its original position after being pressed towards the hooking end 663.

Figure 5:
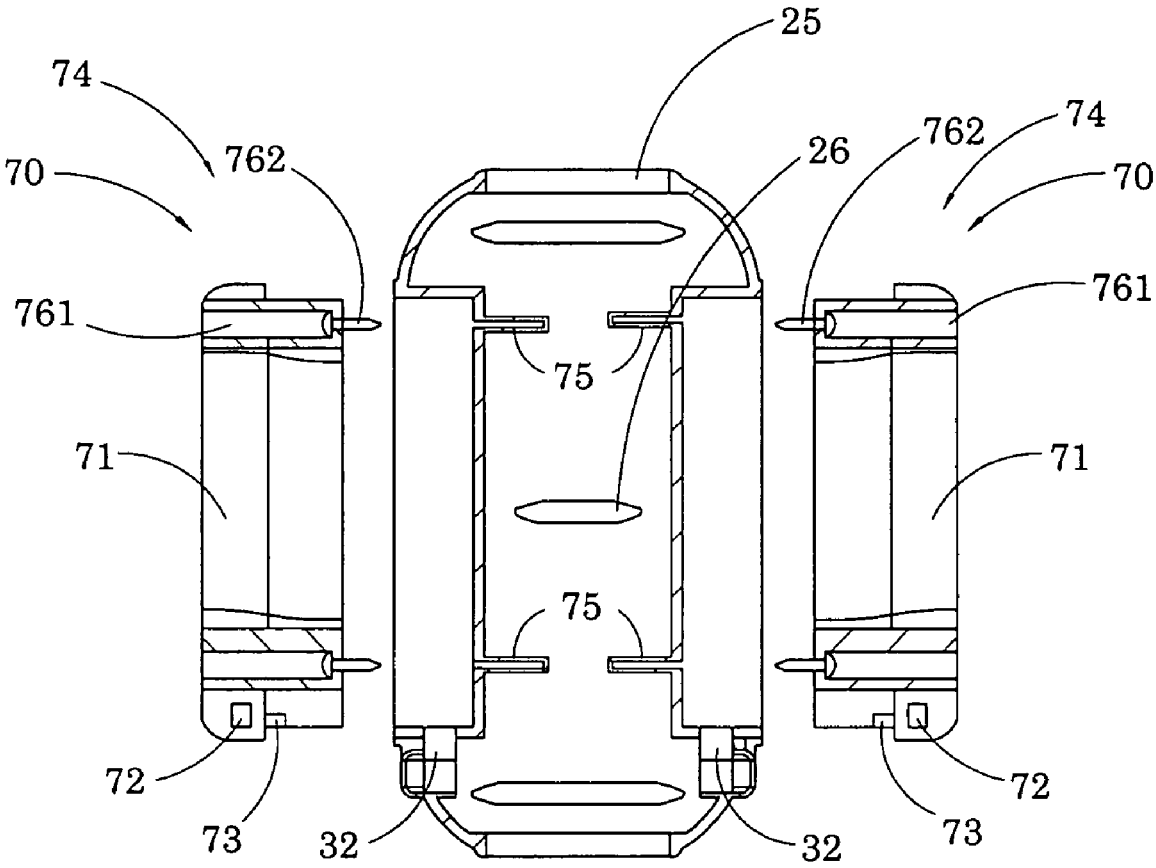
FIG. 5 illustrates a third alternative mode of the locking arrangement according to the above preferred embodiment of the present invention, wherein the rechargeable battery unit is securely fastened by a plurality of mounting screws.

Referring to FIG. 5 of the drawings, a third alternative of the rechargeable power source 70 is illustrated. The rechargeable power source 70 comprises a rechargeable battery unit 71 having a power outlet 72 for electrically connecting with an external power source in charging manner, and a battery terminal 73 arranged to contact with the electrical terminal 32 of the electrical arrangement 30. The rechargeable power source 70 also includes a locking arrangement 74 which comprises a locker slot 75 provided at the supporting shaft 22 and a releasable locker 76 extended from the rechargeable battery unit 71 to detachably couple the rechargeable battery unit 71 with the supporting shaft 22 and to ensure the battery terminal 73 being contact with the electrical terminal 32 so as to electrically connect the rechargeable battery unit 71 with the electrical arrangement 30.

The releasable locker 76 contains a mounting slot 761 aligned with the locker slot 75 when the rechargeable battery unit 71 is disposed in the battery compartment 27 and comprises a mounting screw 762 detachably engaging with said locker slot 75 through the mounting slot 761 to detachably mount the rechargeable battery unit to the battery compartment 27 so as to ensure the battery terminal 73 being contact with the electrical terminal 32.

Figure 6:
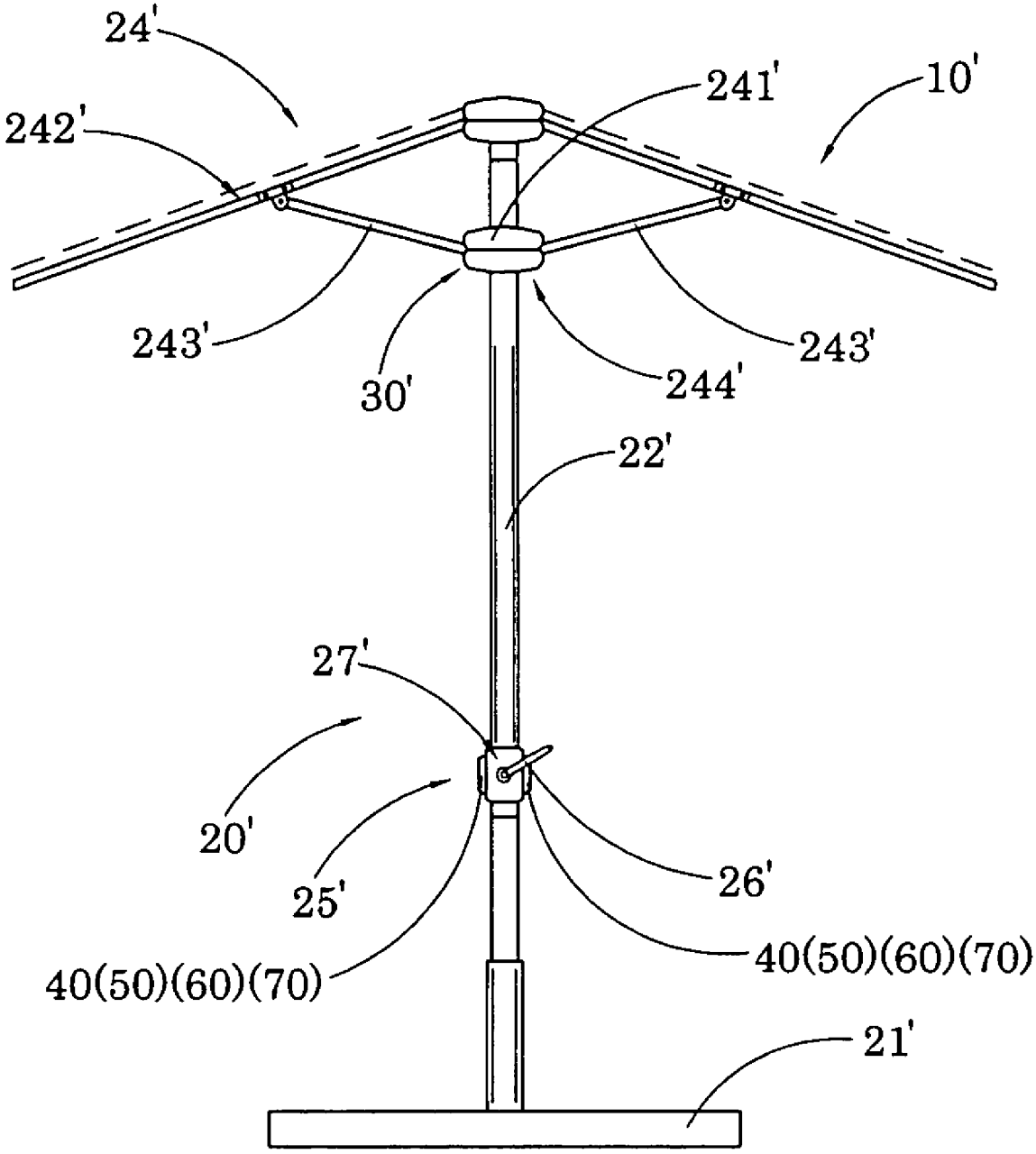
FIG. 6 illustrates an alternative mode of the umbrella frame in which above mentioned locking arrangements can be installed.

Referring to FIG. 6 of the drawings, the rechargeable power source 40 and its alternatives 50, 60, 70 of the present invention can be incorporated with another type of outdoor umbrella to electrically connect to the electrical arrangement 30' thereof without using an electrical cord.

The umbrella frame 20' comprises a base 21', a supporting shaft 22' vertically mounted on top of the base 21' and a foldable awning frame 24' suspendedly supported by the supporting shaft 22' and coupled with the umbrella awning 10' to define a shading area.

As shown in FIG. 6, the umbrella frame 20' further comprises an operation housing 25', an operational unit 26' and a battery compartment 27', wherein the operation unit 26' is adapted for selectively operating the awning frame 24' at an unfolded position and a folded position. The battery compartment 27' is provided at a sidewall of the operation housing 25'.

The awning frame 24' comprises an upper housing 241' and a plurality of awning supporting arms 242' outwardly and radially extended from the upper housing 241' in such a manner that they are adapted to move between a folded position and an unfolded position, wherein in the folded position, the awning supporting arms 242' are pivotally and inwardly folded to overlappedly lay in position, wherein in the unfolded position, the awning supporting arms 242' are pivotally and outwardly extended to support the umbrella awning 10' thereon and to define a shading area under the awning supporting arms 242'. The awning frame 24' further comprises a pair of lower connecting bars 243' each having a first end slidably mounted on the awning supporting arms 242', and a second end mounted on a lower housing 244' provided below the upper housing 241'.

The electrical arrangement 30' is embodied as a speaker supported at the lower housing 244' of the awning frame 24', wherein the electrical arrangement 30' is pre-wired that the electrical terminal is provided at the battery compartment 27'. Therefore, the rechargeable power source 40, 50, 60, 70, is detachably coupled at the operation housing 25' to electrically connect with the electrical arrangement 30'.

Figure 7:
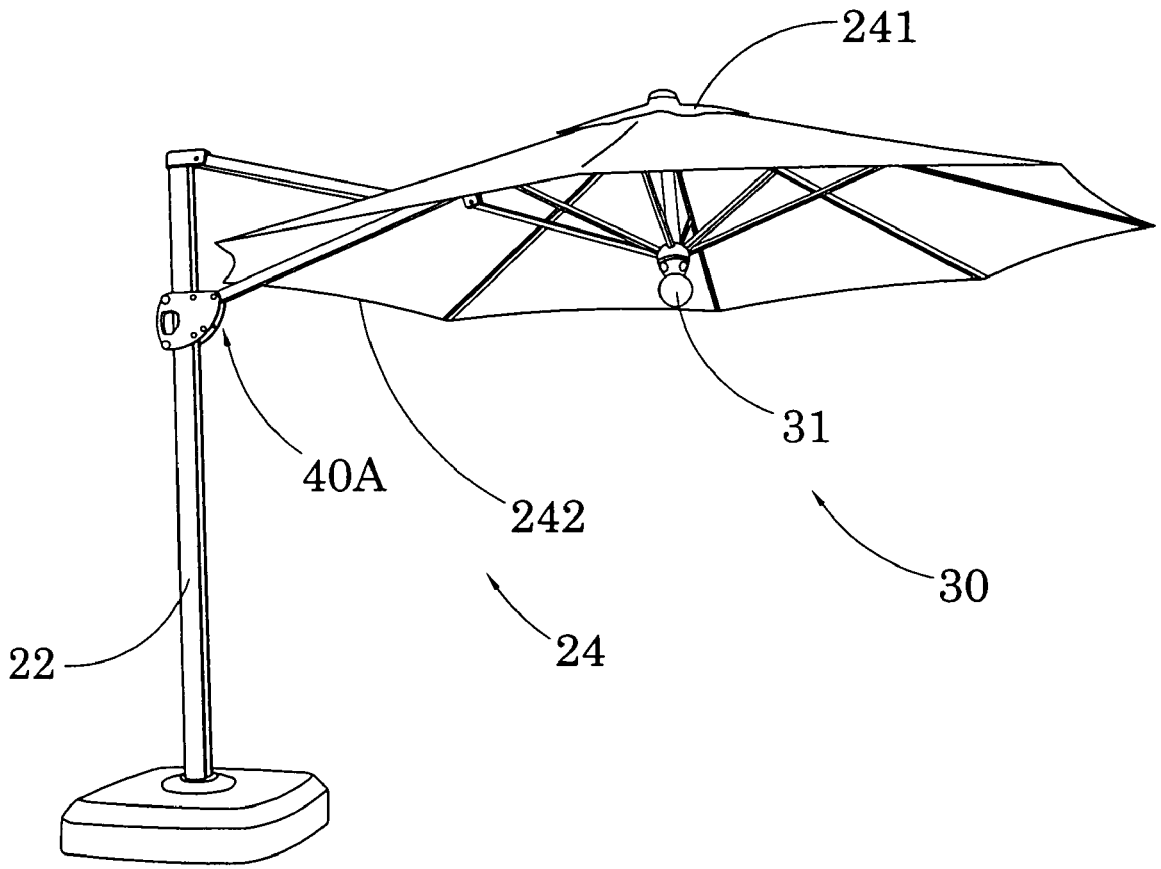
FIG. 7 is a perspective view of an outdoor umbrella with a rechargeable battery arrangement according to a second preferred embodiment of the present invention.
Figure 8:
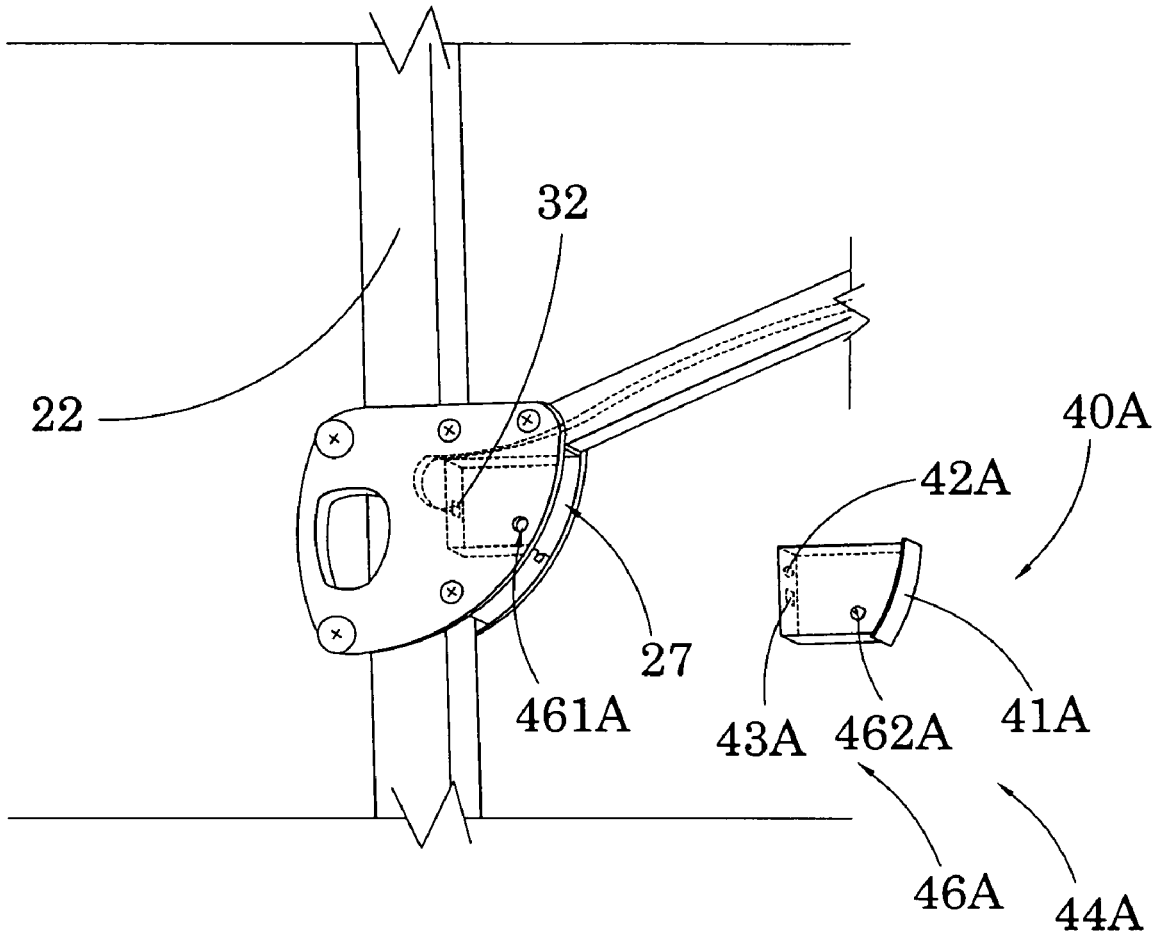
FIG. 8 is an exploded perspective view of the rechargeable battery arrangement for the outdoor umbrella according to the above second preferred embodiment of the present invention.
Figure 9:
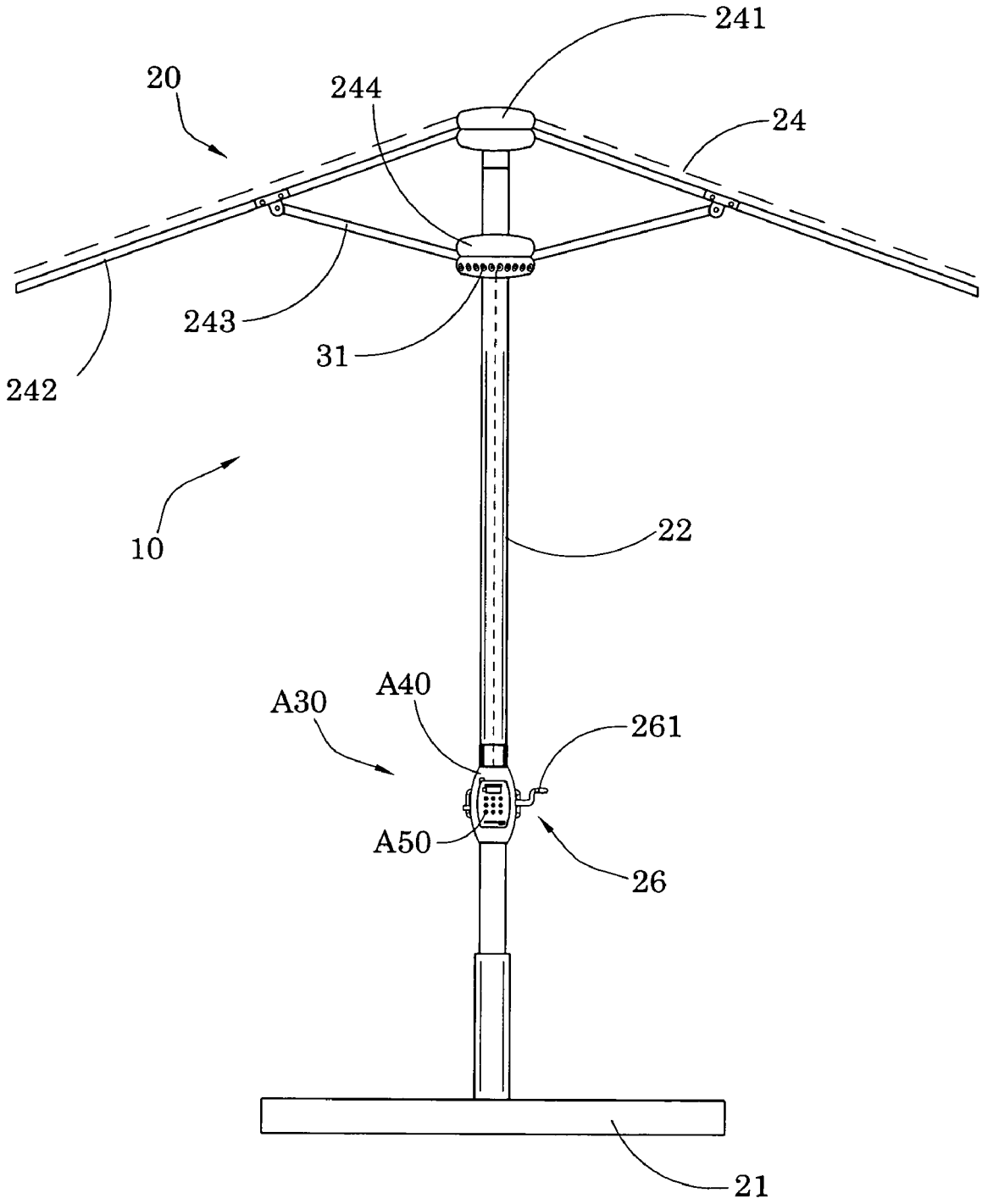
FIG. 9 is a perspective view of an outdoor shading device with a controller unit according to a third preferred embodiment of the present invention.

FIGS. 7 and 8 illustrate an alternative mode of the rechargeable power source 40A. The rechargeable power source 40A comprises a rechargeable battery unit 41A having a power outlet 42A for electrically connecting with an external power source in charging manner, and a battery terminal 43A arranged to contact with the electrical terminal 32 of the electrical arrangement 30. The rechargeable power source 40A also includes a locking arrangement 44A for retaining the rechargeable battery unit 41A at the umbrella frame 20. The locking arrangement 44A comprises a releasable locker 46A to detachably couple the rechargeable battery unit 41 A with the supporting shaft 22 and to ensure the battery terminal 43A being contact with the electrical terminal 32 so as to electrically connect the rechargeable battery unit 41A with the electrical arrangement 30.

As shown in FIG. 7, the electrical terminal 32 is provided at the foldable awning frame 24 to engage with the releasable locker 46A and to electrically contact with the battery terminal 43A respectively when the rechargeable battery unit 41A is mounted at foldable awning frame 24.

As it is mentioned above, the awning frame 24 comprises an upper housing 241 and a plurality of awning supporting arms 242. The rechargeable battery unit 41A is detachably mounted at one of the awning supporting arms 242 which is pivotally and slidably connected to the supporting shaft 22. Accordingly, the respective awning supporting arm 242 has a first end slidably coupled at the supporting shaft 22 and a second end pivotally coupled at the upper housing 241. A battery compartment 27 is provided at the first end of the awning supporting arm 242 for the rechargeable battery unit 41A receiving in the battery compartment 27. As shown in FIG. 8, the first end of the awning supporting arm 242 forms a coupling joint to slidably engage with the supporting shaft 22 and to allow the awning supporting arm 242 to pivotally move with respect to the supporting shaft 22. It is worth to mention that the electrical device 31 is electrically coupled with the electrical terminal 32 in a pre-wiring manner, wherein the electric cable is extended through the respective awning supporting arm 242 to electrically couple between the electrical device 31 and the electrical terminal 32 such that the pivotal movement of the awning frame 24 will not affect the electrical connection of the electrical device 31. Thus, the user is able to reach the rechargeable battery unit 41 A when the user locates within the shading area of the outdoor umbrella.

As shown in FIG. 8, the releasable locker 46A contains a through locker slot 461A provided at one of the sidewall of the battery compartment 27 and a locking protrusion 462A which is retractably extended from the rechargeable battery unit 41 A and is arranged in such a manner that when the rechargeable battery unit 41A is received at the battery compartment 27, the locking protrusion 462A is engaged with the locker slot 461A to lock up the rechargeable battery unit 41A at the umbrella frame 20 to ensure the battery terminal 43A being contact with the electrical terminal 32 so as to electrically connect the rechargeable battery unit 41A with the electrical arrangement 30. Therefore, when the awning frame 24 is pivotally moved to fold or unfold the umbrella awning 10, the rechargeable battery unit 41A is correspondingly moved without disconnecting the connection between the rechargeable battery unit 41A and the electrical device 30.

In order to detach the rechargeable battery unit 41A from the battery compartment 27, the user is able to apply an inward pushing force at a free end of the locking protrusion 462A to disengage the locking protrusion 462A from the locker slot 461A so as to remove the rechargeable battery unit 41A from the outdoor umbrella.

As it is mentioned above, the shading device can be a canopy which comprises a canopy awning supported by a canopy supporting frame, wherein the canopy supporting frame comprises an awning supporting frame and a plurality of canopy supporting shafts.

The rechargeable power source of the present invention can be provided at either the awning supporting frame or one of the canopy supporting shafts, wherein the electrical device is provided at the awning supporting frame to electrically couple with the rechargeable power source.

Referring to FIGS. 9 to 13, an outdoor shading device according to another preferred embodiment of the present invention illustrates an alternative mode of the detachable electronic arrangement. The outdoor shading device, which is also embodied as an outdoor umbrella, comprises an umbrella awning 10, an umbrella frame 20 which supports the umbrella awning 10, and an electrical arrangement 30 supported at the umbrella frame 20. The umbrella frame 20 comprises a base 21, a supporting shaft 22 vertically mounted on top of the base 21, and a foldable awning frame 24 suspendedly supported by the supporting shaft 22 and coupled with the umbrella awning 10 to define the shading area under the umbrella awning 10. The awning frame 24 comprises an upper housing 241 and a plurality of awning supporting arms 242 outwardly and radially extended from the upper housing 241 in such a manner that they are adapted to move between a folded position and an unfolded position, wherein in the folded position, the awning supporting arms 242 are pivotally and inwardly folded to overlappedly lay in position, wherein in the unfolded position, the awning supporting arms 242 are pivotally and outwardly extended to support the umbrella awning 10 thereon and to define a shading area under the awning supporting arms 242. The awning frame 24 further comprises a plurality of lower connecting bars 243 each having a first end movably mounted on the awning supporting arms 242, and a second end mounted on a lower housing 244 provided below the upper housing 241.

The outdoor shading device also comprises a controller unit A30 for centrally and selectively controlling electrical arrangement 30 and an electronic appliance A20 incorporated with the outdoor shading device via electrically link to a CUP of the controller unit A30. In other words, the rechargeable power source 40 can be substituted by the controller unit A30.

As it is mentioned above, the electrical arrangement 30 may includes fans, speaker system, environmental sensor device, lighting apparatus, wherein the electronic appliances A20 can be any personal portable electronic device 21 electrically linking to the controller unit A30 for adjustably controlling the electronic appliances A20. Therefore, a user is able to incorporate his/her own portable electronic device A21 with the outdoor shading device. For instance, the user is able to electrically connect the "iPhone", other smart phones, or MP3 player of portable electronic device A21 to the controller unit A30 for playing music through the integrated speakers of the outdoor shading device and controllably adjust the volume of the speaker through the controller unit A30.

According to the preferred embodiment, the controller unit A30 comprises an operation housing A40 mounted at the supporting shaft 22 of the umbrella frame 20 at a hand reachable location, wherein the operation housing A40 has a first wall surface A41 and a second wall surface A42, and a control panel A50 being supported at the first wall surface 41 of the operation housing A40.

According to the preferred embodiment, the operation unit 26 is received at the operation housing A40 such that the operation housing A40 forms an integrated component of the outdoor shading device. Accordingly, the operation handle 261 is rotatably coupled at the operation housing A40 between the first and second wall surfaces A41, A42 thereof to actuate the folding cable for controlling the awning frame 24 at the unfolded position and the folded position.

The controller unit A30 further comprises an electronic appliance holder A60 provided at the second wall surface A42 of the operation housing A40 for holding the electronic appliance thereat, wherein the control panel A50 is adapted for communicatively linking to the electronic appliance A20 to selectively control an operation of the electronic appliance A20.

As shown in FIGS. 11 to 15, the first and second wall surfaces A41, A42 of the operation housing A40 are two opposed surfaces and are enlarged flat surfaces to incorporate with the control panel A50 and the electronic appliance holder A60 respectively. Therefore, the operation housing A40 is able to support both the controller unit A30 and the electronic appliance holder A60 at the same time. Accordingly, the electronic appliance holder A60 is preferably adapted for holding the electronic appliances A20 thereon, especially the personal portable electronic device A21 as mentioned above. Thereby, the electronic appliance holder A60 is able to mount on the umbrella frame 20 via the operation housing A40, and arranged that the portable electronic device A21 is able to be securely held at a position adjacent to the controller unit A30. Thus, the portable electronic device A21 is able to easily and electrically connect to the controller unit A30 for incorporating with other electrical components of the outdoor shading device.

Accordingly, the operation housing A40 further has a receiving cavity A43 indently formed at the second wall surface A42 to detachably receive the electronic appliance holder A60 within the receiving cavity A43.

According to the preferred embodiment, the control panel A50 comprises a controller interface A51 operatively controlling the electrical arrangement 30 and a wireless communication link A52 for communicatively linking with the electronic appliance A20 in a wireless connection manner, so as to enable the controller interface A51 being activated to control the operations of the electrical arrangement 30 and the electronic appliance A20.

Figure 10:
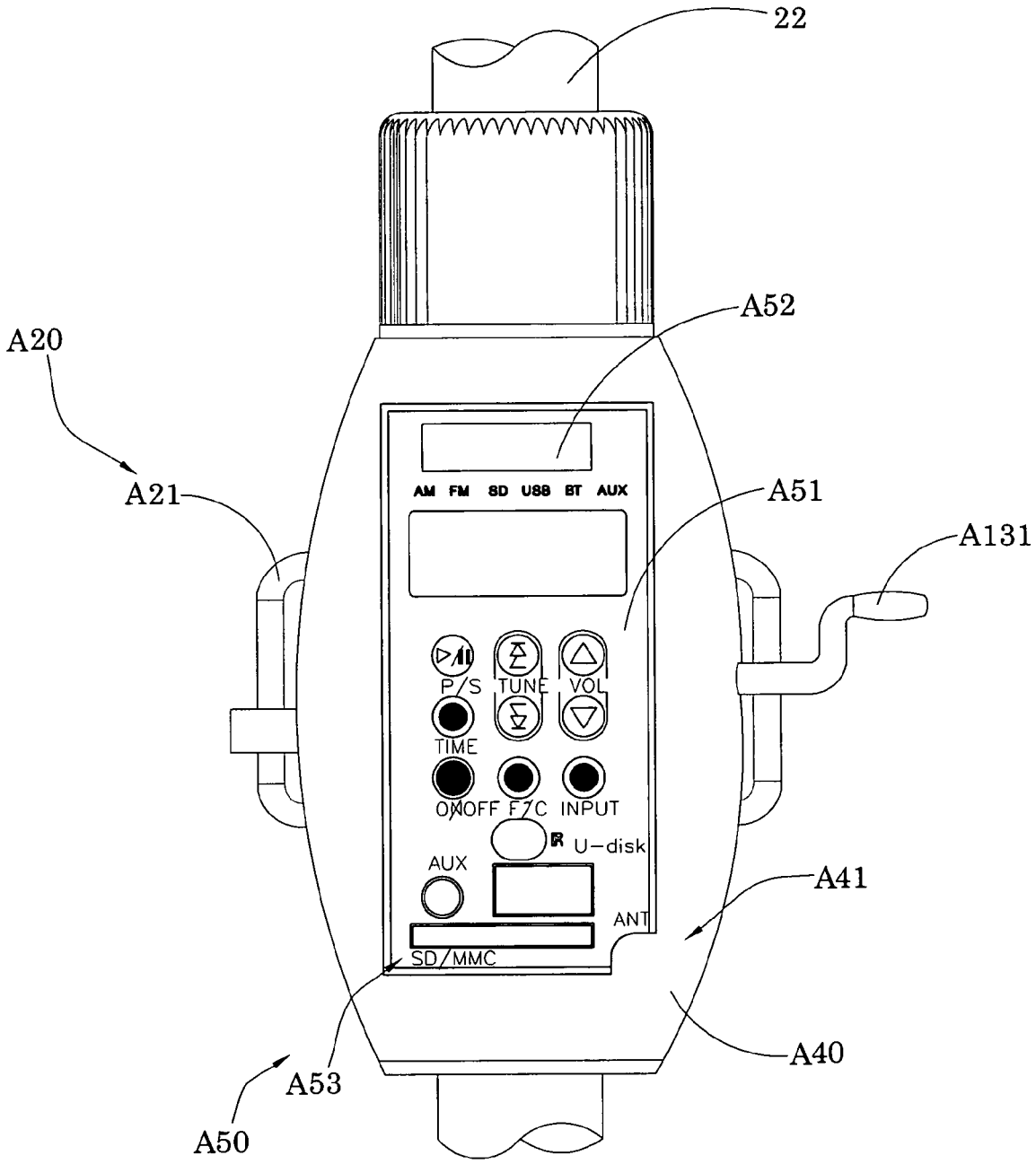
FIG. 10 is a front view of the controller unit according to the above preferred embodiment of the present invention, illustrating the control interface of the controller unit.

As shown in FIG. 10, the controller interface A51 has a plurality of preference settings, remotely control the electronic appliance A20 and the electrical components of the outdoor shading device for centrally activating the outdoor shading devices A10 in responsive to the preference settings, such as light intensity, volume, and time etc. For instance, the preference settings may comprises a plurality controlling keys for selectively adjust the volume by pressing UP or DOWN keys thereof, and/or for increasing or decreasing the light intensity of the lighting apparatus of the outdoor shading device. Alternatively, the preference settings may be adjusted via a touch screen controlling panel.

The control panel A50 further comprises one or more connecting slots A53, such as SD card slot and/or USB slot, for electrically linking with external electronic appliances A20, such as the above mentioned portable electronic device A21, so that the portable electronic device A21 is able to simply plug into the connecting slot A53 for incorporating with the outdoor shading device via a connecting cable. Therefore, the user is able to simply plug a MP3 player of the portable electronic device A21 for electrically linking the MP3 player with the speaker of the electronic appliance A20 of the outdoor shading device and/or place the personal portable electronic device A21 at the holder for conveniently connecting to the connecting slot A53, so that the user is able to play the music through the speaker of the outdoor shading device, so as to adjust the volume or the likes through the setting preferences on the control panel A50.

The electronic appliance holder A60 has a storage side A61 and an opposed holding side 62 arranged in such a manner that when the storage side A61 of the electronic appliance holder A60 is engaged with the operation housing A40, the holding side A62 of the electronic appliance holder A60 faces outwardly for holding the electronic appliance A20 in position, and when the holding side A62 of the electronic appliance holder A60 is engaged with the operation housing A40, the storage side 61 of the electronic appliance holder A60 is aligned with the second wall surface A42 to house the electronic appliance holder A60 at the operation housing A40.

Figure 11:
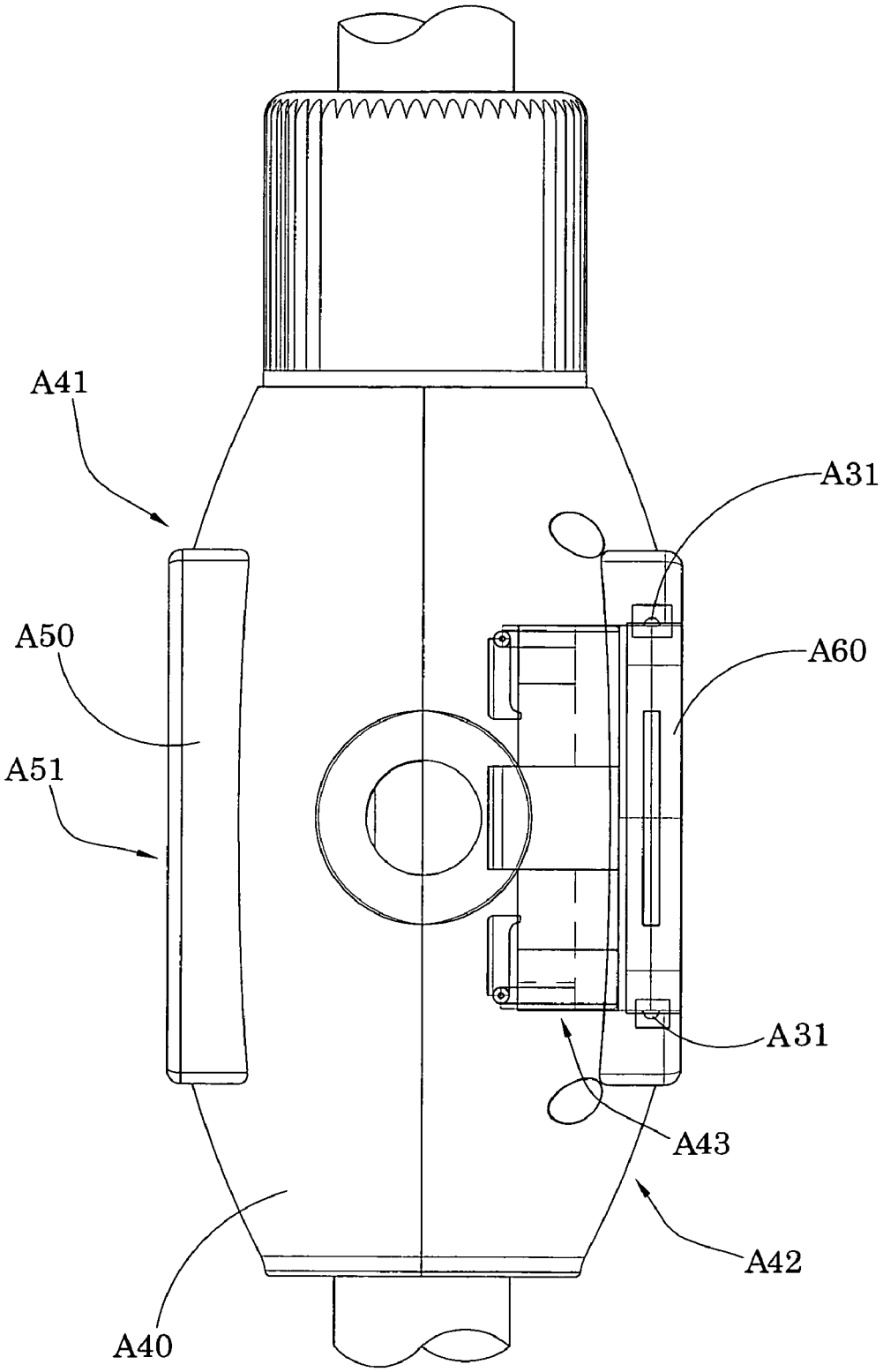
FIG. 11 is a side sectional view of the controller unit according to the above preferred embodiment of the present invention, illustrating the retraction unit receiving in the receiving cavity of the operation housing in a hidden manner.
Figure 12:
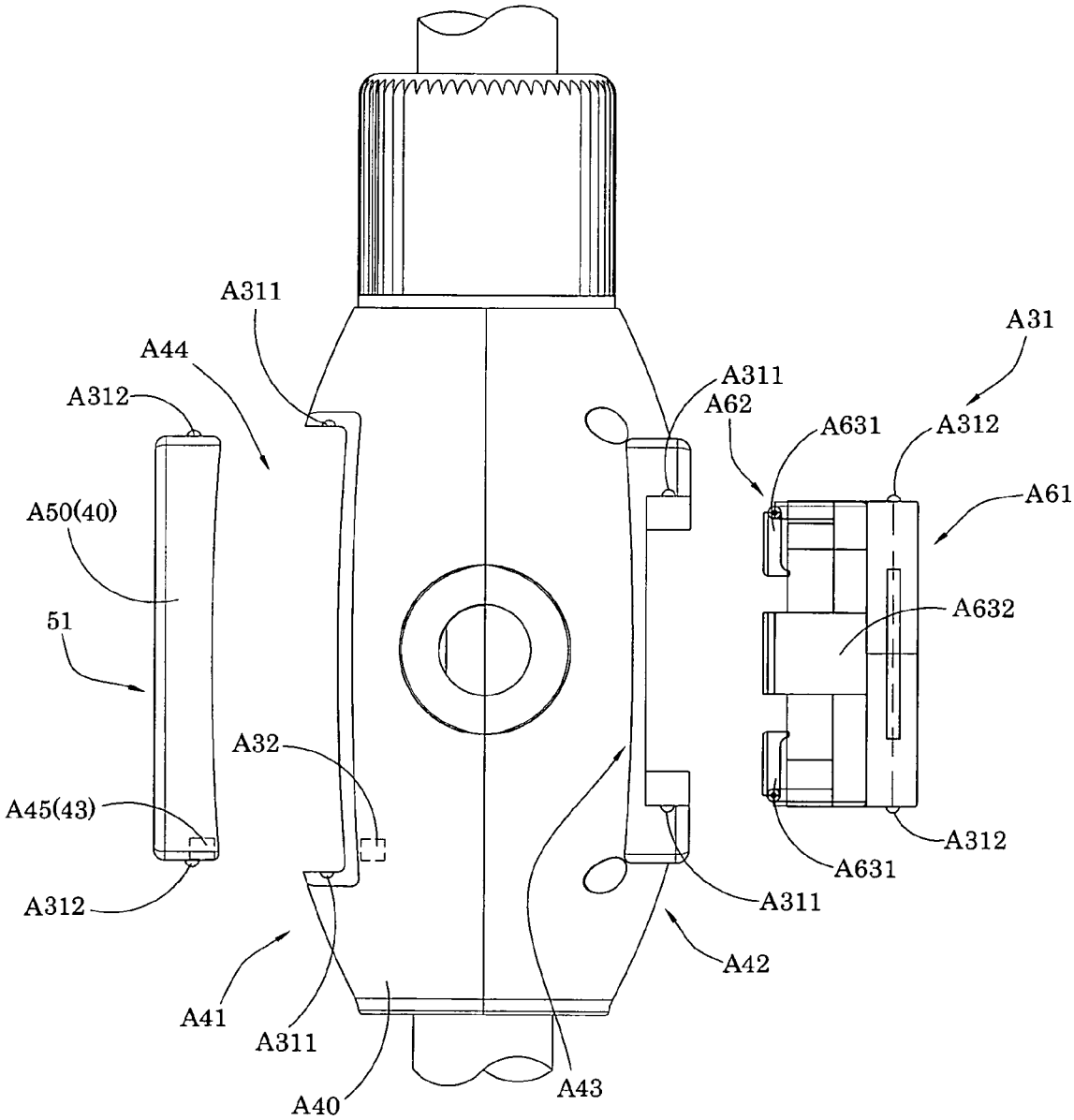
FIG. 12 is another side sectional view of the controller unit according to the above preferred embodiment of the present invention, illustrating the electronic appliance holder being detached from the operation housing.
Figure 14:
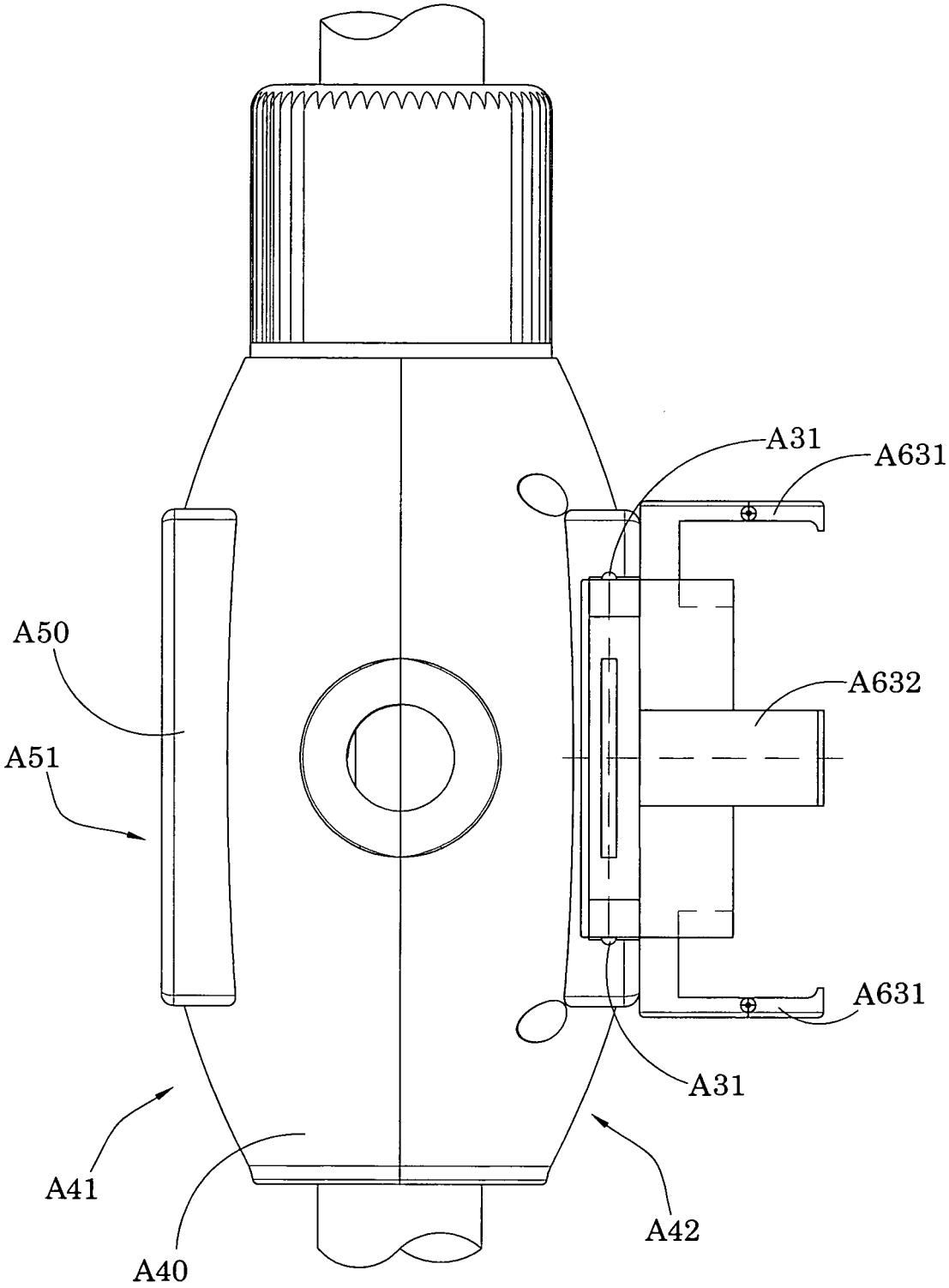
FIG. 14 is still another side sectional view of the controller unit according to the above preferred embodiment of the present invention, illustrating the retracting arms at an extended position.
Figure 15:
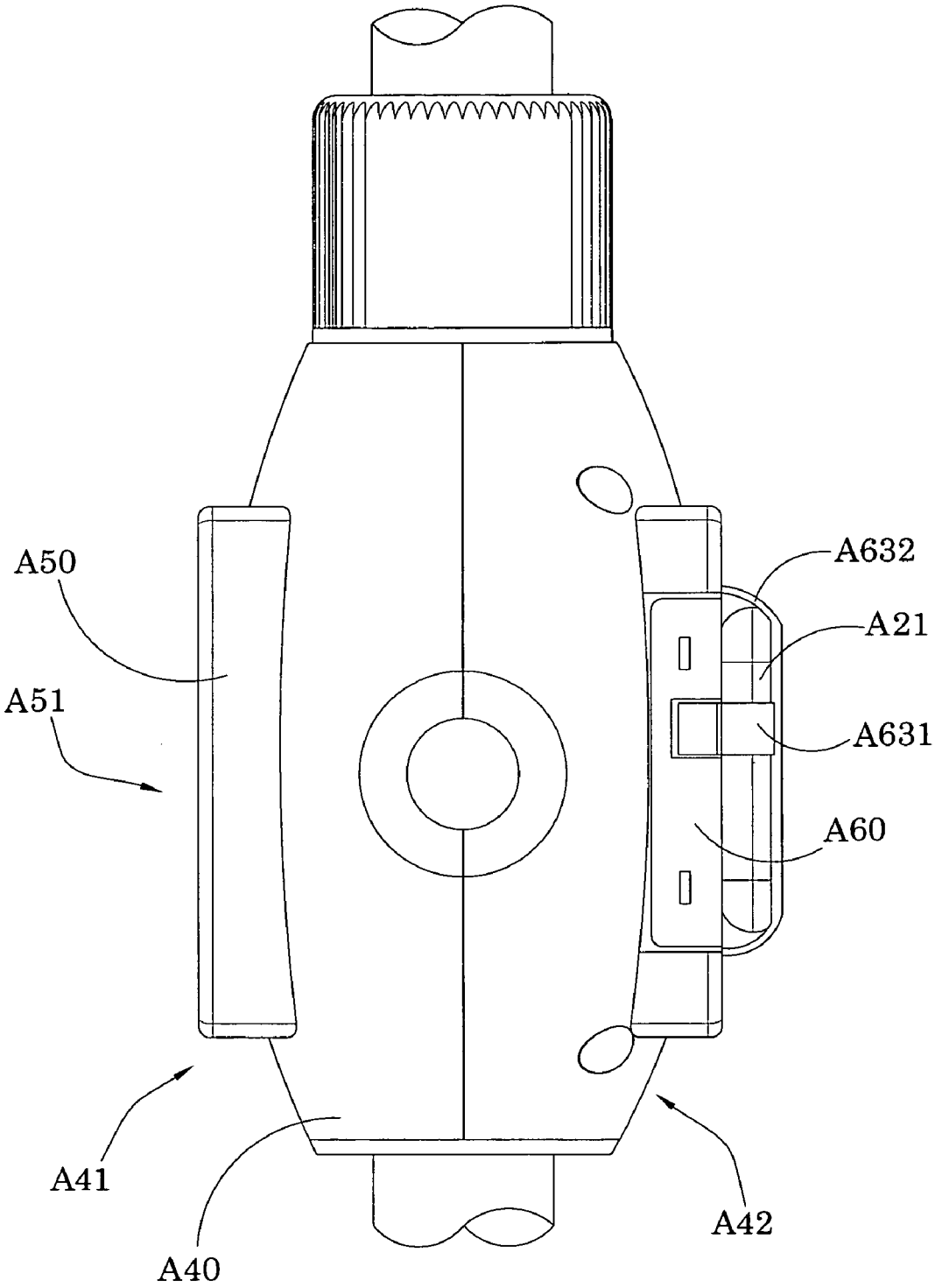
FIG. 15 is a sectional view of the controller unit according to the above preferred embodiment of the present invention, illustrating the storage side of the electronic appliance holder facing outwardly.
Figure 16:
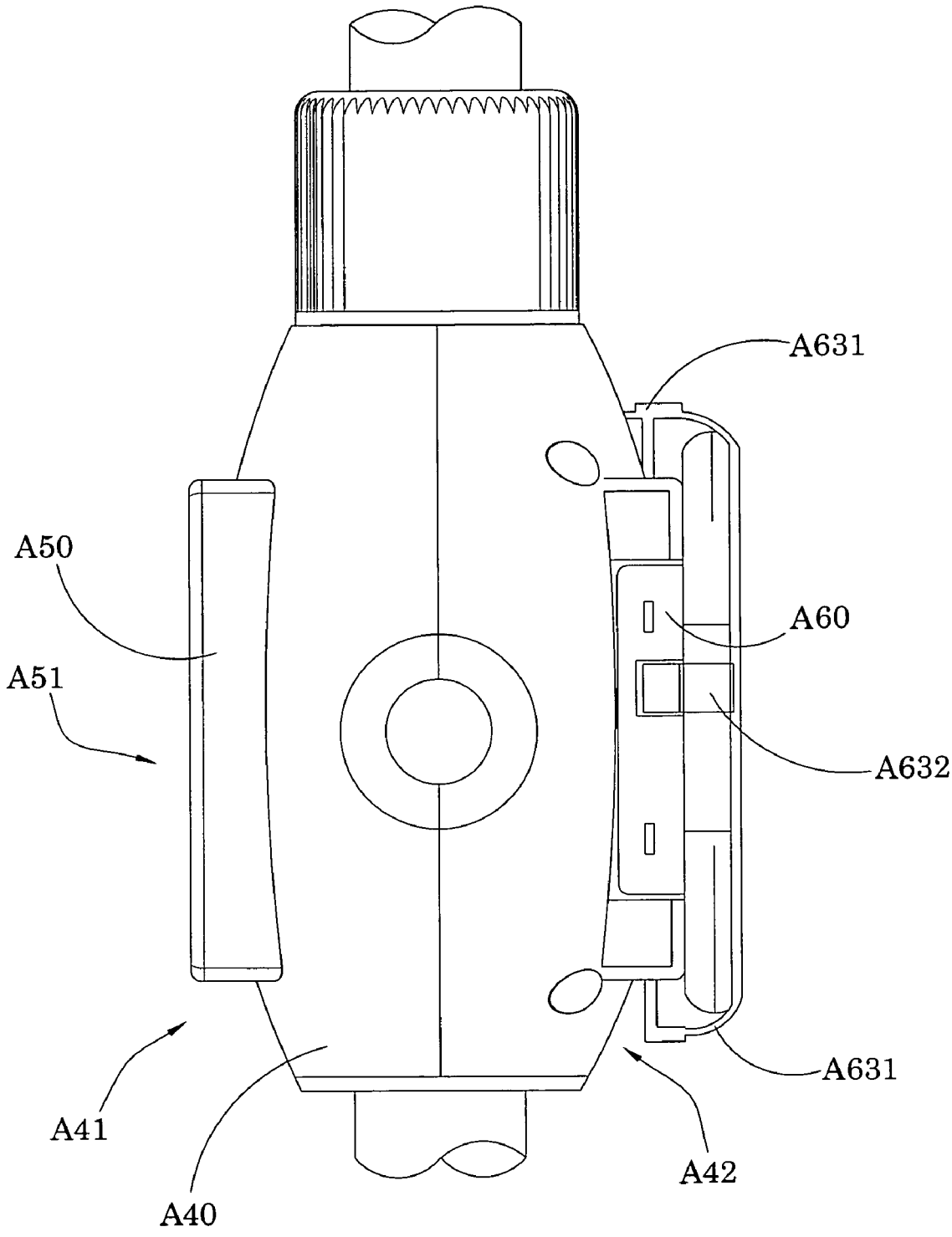
FIG. 16 is a side view of the controller unit according to the above preferred embodiment of the present invention, illustrating the electronic appliance being held at the holding side of the electronic appliance holder.

Accordingly, the electronic appliance holder A60 is able to be detached from the operation housing A40 to select either one of the storage side A61 and the holding side A62 of the electronic appliance holder A60 to be coupled at the second wall surface A42 of the operation housing A40 so as to transform the electronic appliance holder 60 between the storage position and the operation position, as shown in FIG. 11 and FIG. 14 respectively. Therefore, at the storage position of the electronic appliance holder A60, the holding side A62 of the electronic appliance holder A60 is detachably coupled within the receiving cavity A43 of the operation housing A40 so as to embed the electronic appliance holder A60 within the operation housing A40 at the second wall surface A42 thereof. At the operation position, the storage side A61 of the electronic appliance holder 60 is detachably coupled within the receiving cavity A43 of the operation housing A40 so that the holding side A62 of the electronic appliance holder A60 is outwardly protruded from the second wall surface A42 of the operation housing A40 for holding the electronic appliance A20 in position. Therefore, the portable electronic device A21 is able to be supported on the umbrella frame 20 while being able to conveniently plug the connecting cable or a connector of the portable electronic device A21 into the connecting slot A53 of the controller unit A50.

It will be readily appreciated that the storage side A61 and the holding side A62 of the electronic appliance holder A60 have identical shape and size corresponding to the receiving cavity A43 for detachably engaging the electronic appliance holder A60 therewith.

In order to detachably and securely retain the electronic appliance holder A60 within the receiving cavity A43 of the operation housing A40, the controller unit A30 further comprises a releasable interlocker A31 provided at a peripheral wall of the electronic appliance holder A60 to releasably lock the electronic appliance holder A60 within the receiving cavity A43 of the operation housing A40. As shown in FIGS. XXX3, 4 and 12, the releasable interlocker A31 has a plurality of engaging slots A311 provided at a surrounding wall of the receiving cavity A43 of the operation housing A40 and comprises a plurality of corresponding resilient protrusions A312 outwardly protruded from the peripheral wall of the electronic appliance holder A60 to releasably engage with the engaging slots A311 respectively so as to securely retain the electronic appliance holder A60 in position. Accordingly, each of the resilient protrusions A312 can be a spring-loaded protrusion that a head portion thereof is outwardly protruded from the peripheral wall of the electronic appliance holder A60 such that when the user applies a pushing force against the electronic appliance holder A60, the head portions of the resilient protrusions A312 are inwardly pressed along the surrounding wall of the receiving cavity A43 until the head portions of the resilient protrusions 312 engage with the engaging slots A311 to interlock the electronic appliance holder A60 within the receiving cavity A43 of the operation housing A40. When the user applies a pulling force against the electronic appliance holder A60, the head portions of the resilient protrusions A312 are inwardly pressed to unlock the electronic appliance holder A60 within the receiving cavity A43 of the operation housing A40. It is worth mentioning that the releasable interlocker A31 will interlock the electronic appliance holder A60 within the receiving cavity A43 of the operation housing A40 at either the storage side A61 or the holding side A62 of the electronic appliance holder A60.

Figure 17:
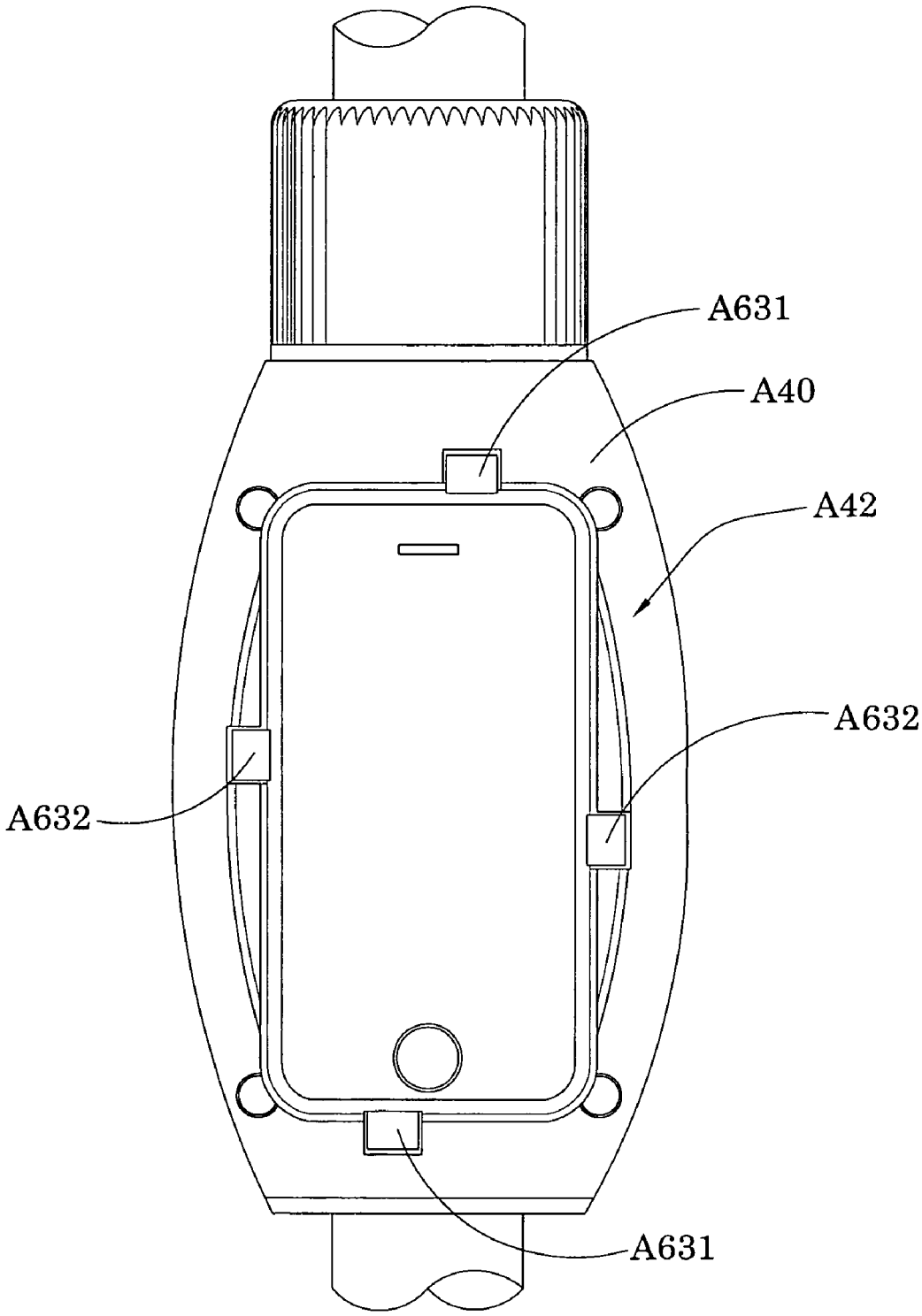
FIG. 17 is a front view of the controller unit according to the above preferred embodiment of the present invention, illustrating the electronic appliance being held at the holding side of the electronic appliance holder at a vertical display orientation.
Figure 18:
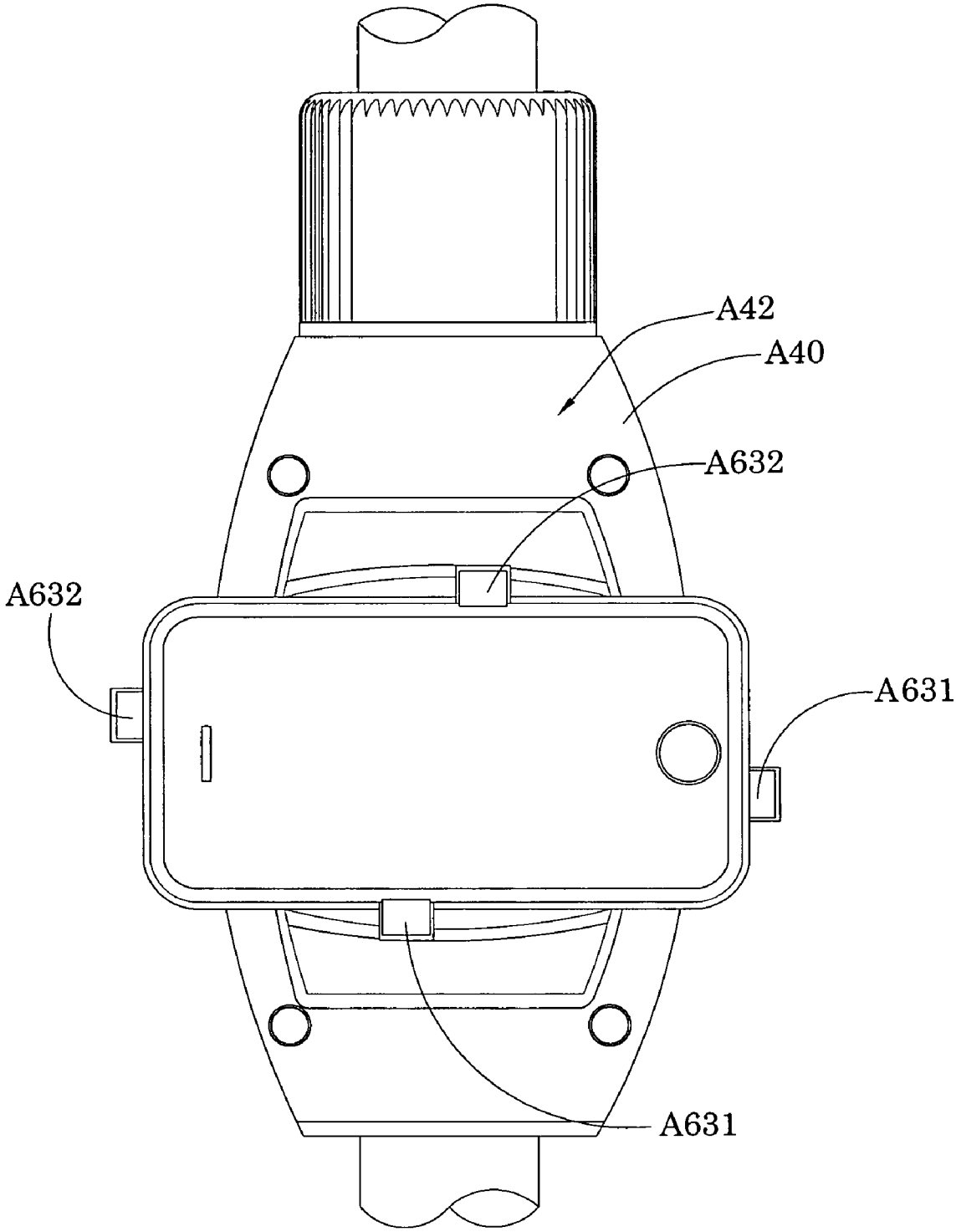
FIG. 18 is a front view of the controller unit according to the above preferred embodiment of the present invention, illustrating the electronic appliance being held at the holding side of the electronic appliance holder at a horizontal display orientation.

The electronic appliance holder A60 further comprises a plurality of length-adjustable retracting arms A63 provided at the holding side A62 of the electronic appliance holder A60 for adjustably holding a surrounding rim of the electronic appliance A20 at the holding side A62 of the electronic appliance holder A60. As shown in FIGS. 17 and 18, the retracting arms A63 are formed in pairs to have a pair of first retracting arms A631 and a pair of second retracting arms A632.

Figure 19A:
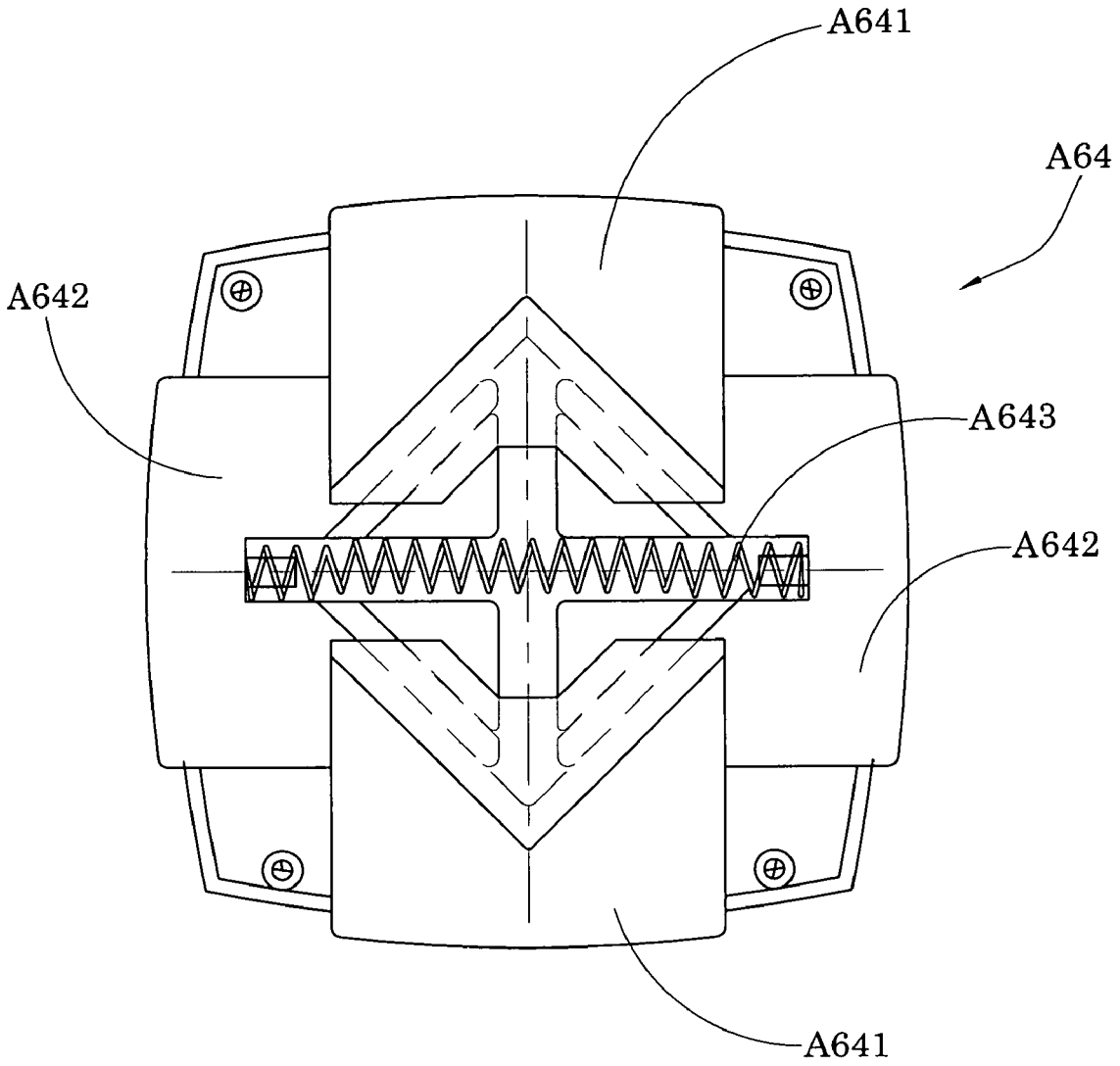
FIGS. 19A to 19C are different sectional views of the controller unit according to the above preferred embodiment of the present invention, illustrating the structural configuration of the retraction unit.

As shown in FIGS. 19A, 19B, 19C, and 20, the electronic appliance holder A60 further comprises a retraction unit A64 to control the retraction operation of the retracting arms A63. As shown in FIG. 19A, the retraction unit A64 comprises two transverse locking panels A641, and two longitudinal locking panels A642 inter-engaging with the transverse locking panels A641, and a first spring element A643 biasing between the longitudinal locking panels A642. Accordingly, when a pressing force is applied at the transverse locking panels A641 to reduce the distance therebetween, the longitudinal locking panels A642 are driven to be pressed to reduce the distance therebetween as well so as to compress the first spring element A643. Once the pressing force is released, the first spring element A643 is returned to its original form to outwardly push the longitudinal locking panels A642 as well as the transverse locking panels A641.

Figure 19B:
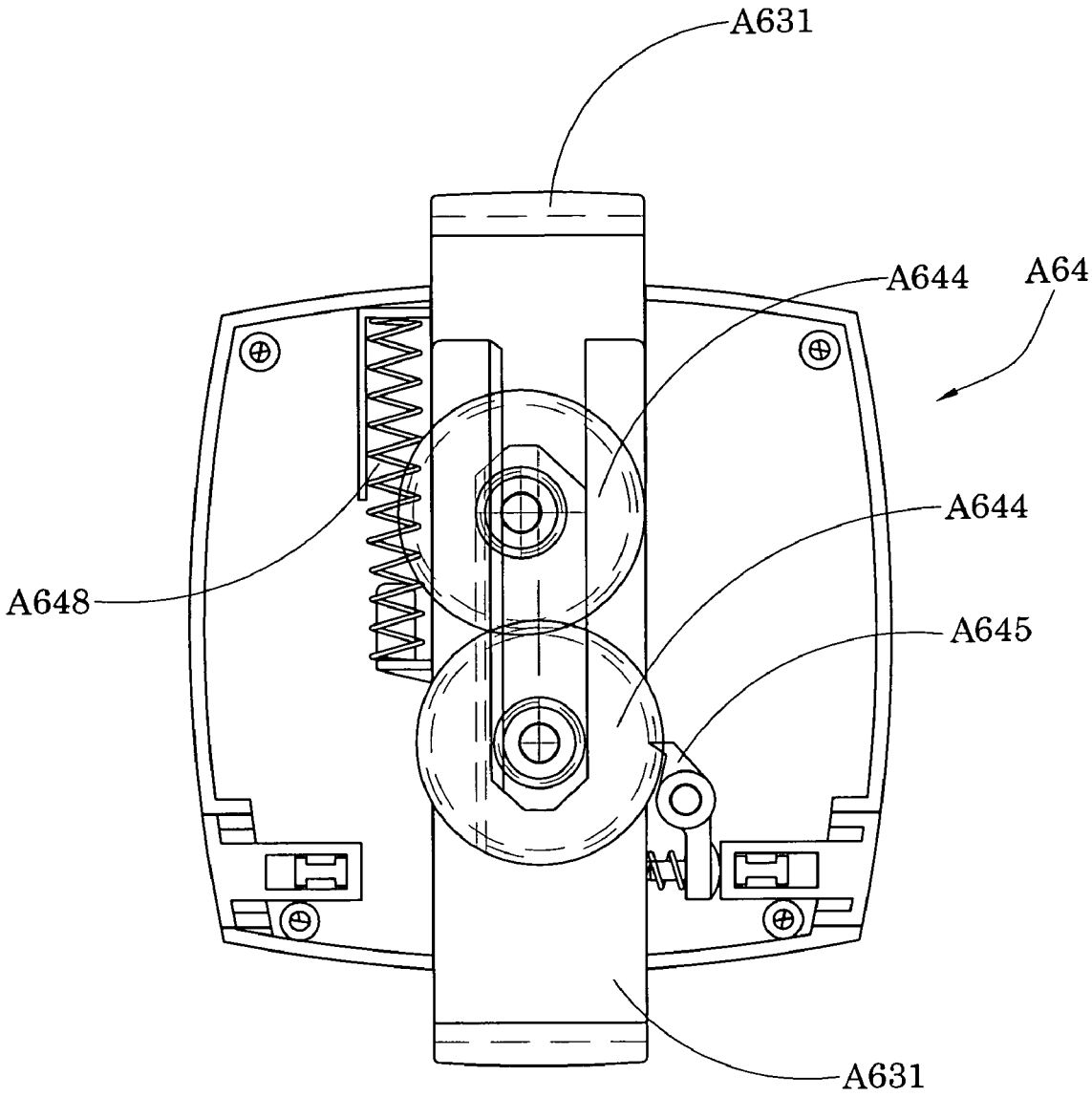

As shown in FIG. 19B, the first retracting arms A631 are alignedly and movably supported in a spaced manner, wherein two first gear members A644 are rotatably coupled with each other and are coupled with the first retracting arms A631 respectively. Preferably, the outer free end of each of the first retracting arms A631 has a hook shape that the distance between the two free ends of the first retracting arms A631 can be selectively adjusted between 55 and 160 mm to hold the electronic appliance in position. A spring-loaded first locking member A645 is movably engaged with one of the first gear members A644, wherein when a pressing force is applied at the free ends of the first retracting arms A631 to drive the first retracting arms A631 towards each other, the first gear members A644 are driven to correspondingly rotated such that when the first locking member A645 releasably engaged with the corresponding first gear member A644, the sliding movements of the first retracting arms A631 are stopped to retain the distance between the free ends of the first retracting arms A631 so as to universally hold variety of sizes of the portable electronic devices A21.

Figure 19C:
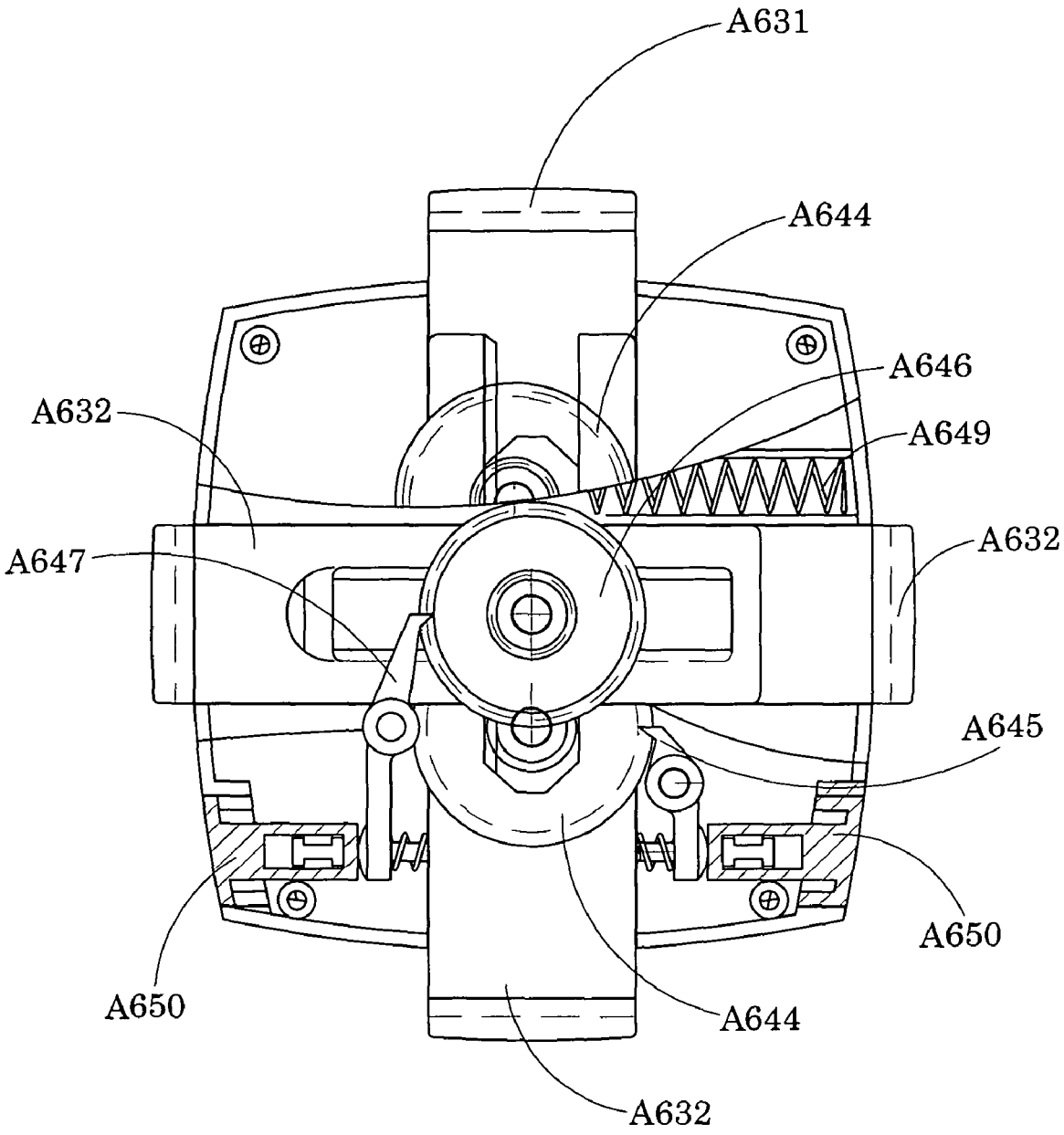
Figure 20:
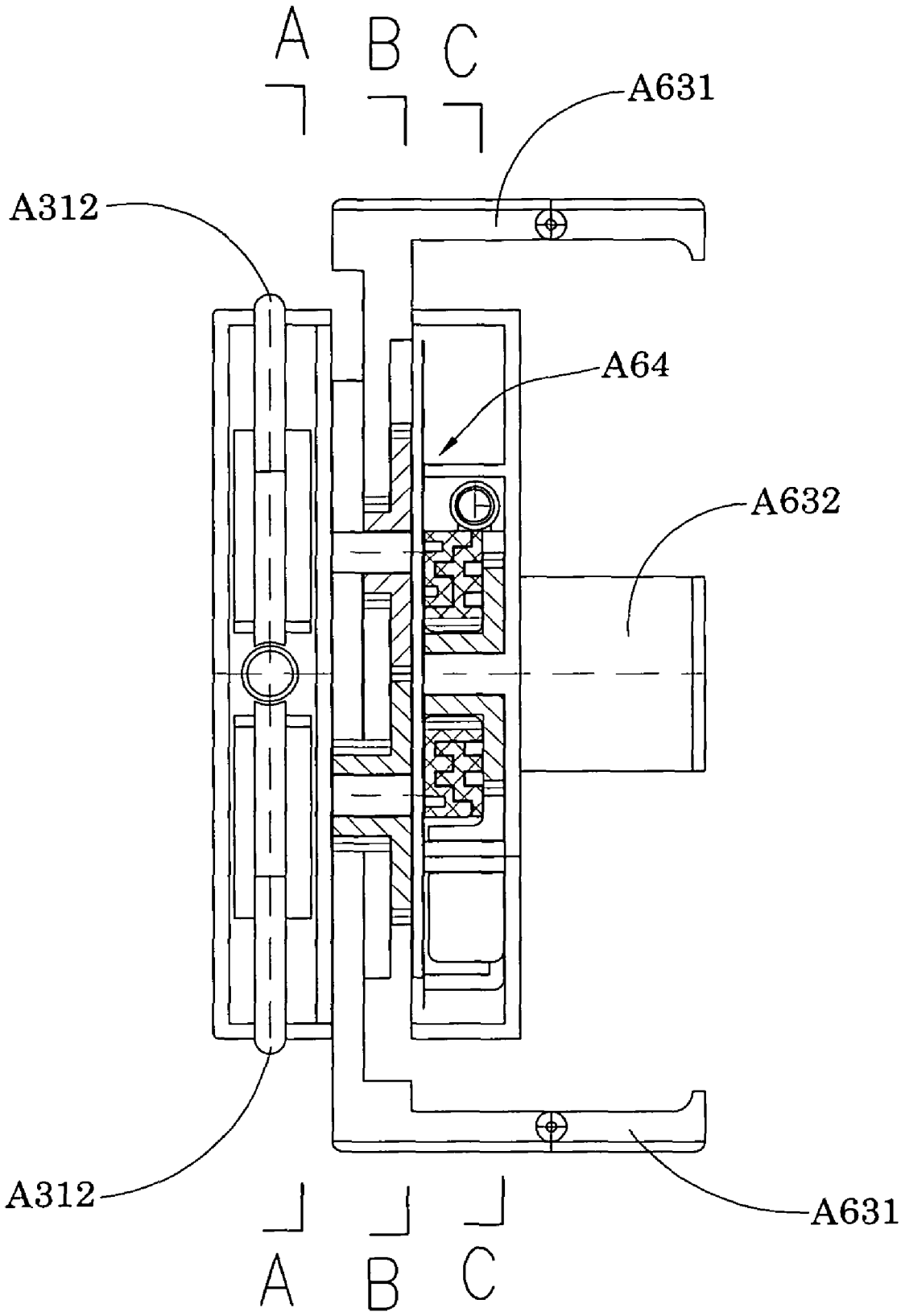
FIG. 20 is a side sectional view of the controller unit according to the above preferred embodiment of the present invention, illustrating the structural configuration of the retraction unit with respect to the FIGS. 19A to 19C.

As shown in FIG. 19C, the second retracting arms A632 are alignedly and movably supported in a spaced manner, wherein a second gear member A646 is rotatably coupled with the second retracting arms A632 respectively. Preferably, the outer free end of each of the second retracting arms A632 has a hook shape that the distance between the two free ends of the second retracting arms A632 can be selectively adjusted to hold the electronic appliance in position. A spring-loaded second locking member A647 is movably engaged with the second gear members A647, wherein when a pressing force is applied at the free ends of the second retracting arms A632 to drive the second retracting arms A632 towards each other, the second gear member A646 is driven to correspondingly rotated such that when the second locking member A647 releasably engaged with the second gear member A646, the sliding movements of the second retracting arms A632 are stopped to retain the distance between the free ends of the second retracting arms A632. As shown in FIGS. 19B and 19C, a second spring element A648 is provided for biasing against the first retracting arms A631 to push the first retracting arms A631 away from each other. A third spring element A649 is provided for biasing against the second retracting arms A632 respectively to push the second retracting arms A632 away from each other.

In order to release the locking position of each of the first and second retracting arms A631, A632, a locker unit A650 is provided to drive the first and second locking members A645, A647 to move. The locker unit A650 comprises two spring-loaded actuators alignedly coupled with the first and second locking members A645, A647, wherein when the actuators are pressed, the first and second locking members A645, A647 are driven to move to release the engagement of the first and second gear members A644, A646 respectively, such that the first and second retracting arms A631, A632 are pushed outwardly via the second and third spring elements A648, A649 respectively.

The electronic appliance holder A60 further comprises a turntable base A66 rotatably coupling at the holding side A62 of the electronic appliance holder A60, wherein the retracting arms A63 are radially and outwardly extended from the turntable base A66 such that the turntable base A66 is adjustably rotated at the holding side A62 of the electronic appliance holder A60 to selectively adjust the electronic appliance between a vertical display orientation, as shown in FIG. 17, and a horizontal display orientation, as shown in FIG. 18. Therefore, the user is able to selectively adjust a viewing orientation of the portable electronic device A21.

It is worth mentioning that when the holding side A62 of the electronic appliance holder A60 is coupled at the second wall surface A42 of the operation housing A40 within the receiving cavity A43, the first and second retracting arms A631, A632 are received within the receiving cavity A43 in a hidden manner such that the storage side A61 of the electronic appliance holder A60 is aligned with the second wall surface A42 of the operation housing A40 so as to keep the aesthetic appearance of the outdoor shading device and to minimize the overall size of the operation housing A40 at the storage position with the electronic appliance holder A60.

Figure 21:
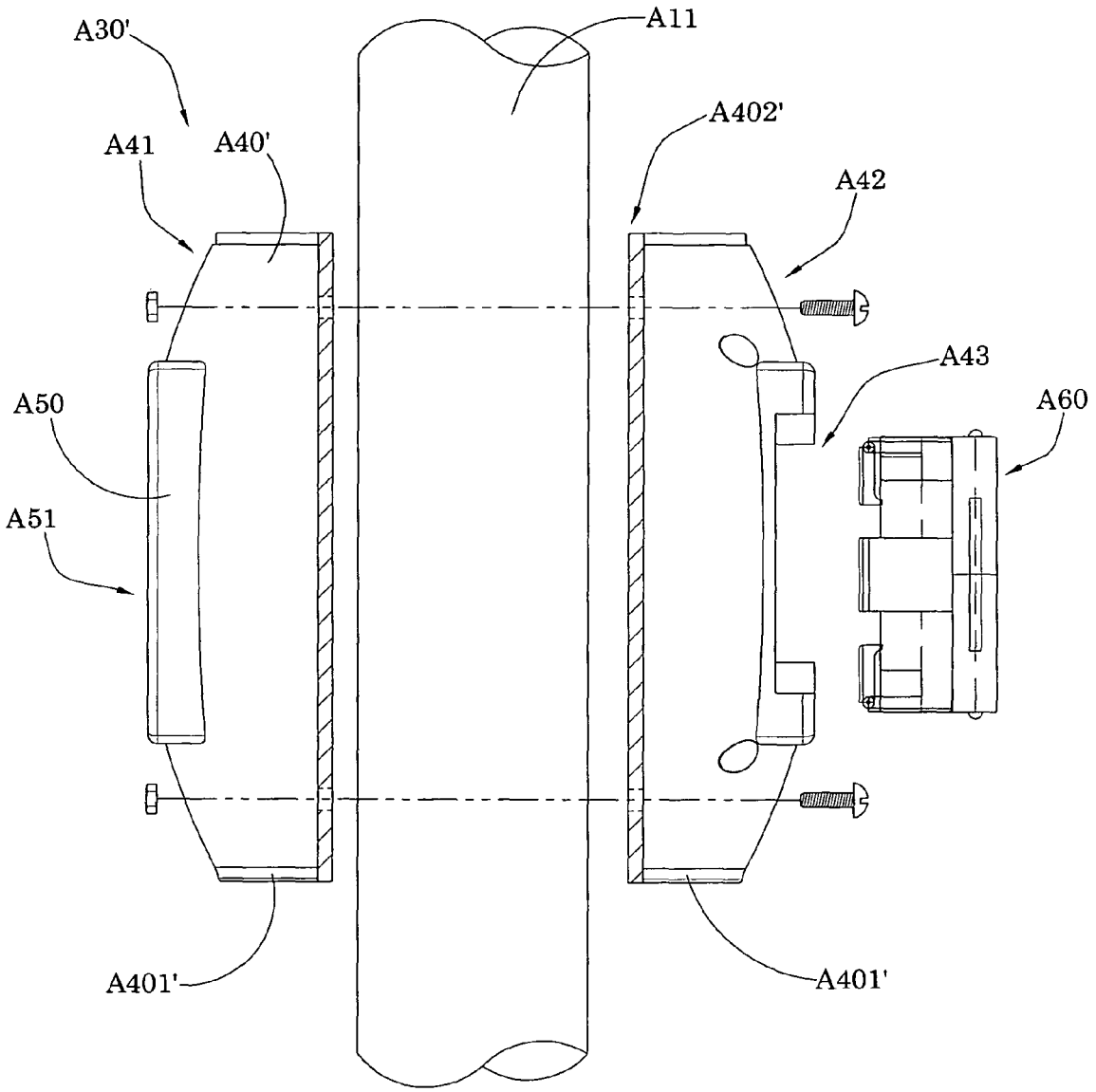
FIG. 21 illustrates an alternative mode the operation housing according to the above preferred embodiment of the present invention, illustrating the controller unit being detachably coupled with the outdoor shading device.

FIG. 21 illustrates an alternative mode of the controller unit A30' of the preferred embodiment, wherein the controller unit A30' is an added-on component of the outdoor shading device. As shown in FIG. 5, the operation housing A40' of the controller unit A30' comprises two housing members A401' detachably coupling with each other and defining a shaft cavity A402' for the shaft of the umbrella frame 20 receiving thereat.

Therefore, the operation housing A40' can be detachably mounted at the umbrella frame 20 via any fastener, such as screw in FIG. 21. In other words, the controller unit A30' can be incorporated with any outdoor shading device having the umbrella frame 20 to hold the electronic appliance A20 at the second wall surface A42 of the operation housing A40' via the electronic appliance holder A60 and to control the electronic appliance A20 by the control panel A50 at the first wall surface A41 of the operation housing A40'. For example, the outdoor shading device can be a canopy which comprises a canopy awning supported by a canopy supporting frame, wherein the canopy supporting frame comprises an awning supporting frame and a plurality of canopy supporting shafts. The operation housing A40' can be provided at either the awning supporting frame or one of the canopy supporting shafts.

It is worth mentioning that the control panel A40 can also be detachably coupled at the first wall surface A41 of the operation housing A40 via the same mechanism of the releasable interlocker A31 such that the control panel A40 not only wirelessly links to the electronic appliance A20 at the second wall surface A42 of the operation housing A40 via the electronic appliance holder A60, but also forms a remote control to wirelessly control the electronic appliance A20. It is appreciated that a second receiving cavity A44 can be formed at the first wall surface A41 of the operation housing A40 to receive the control panel A40 at the cavity of the operation hosing A40.

Figure 13:
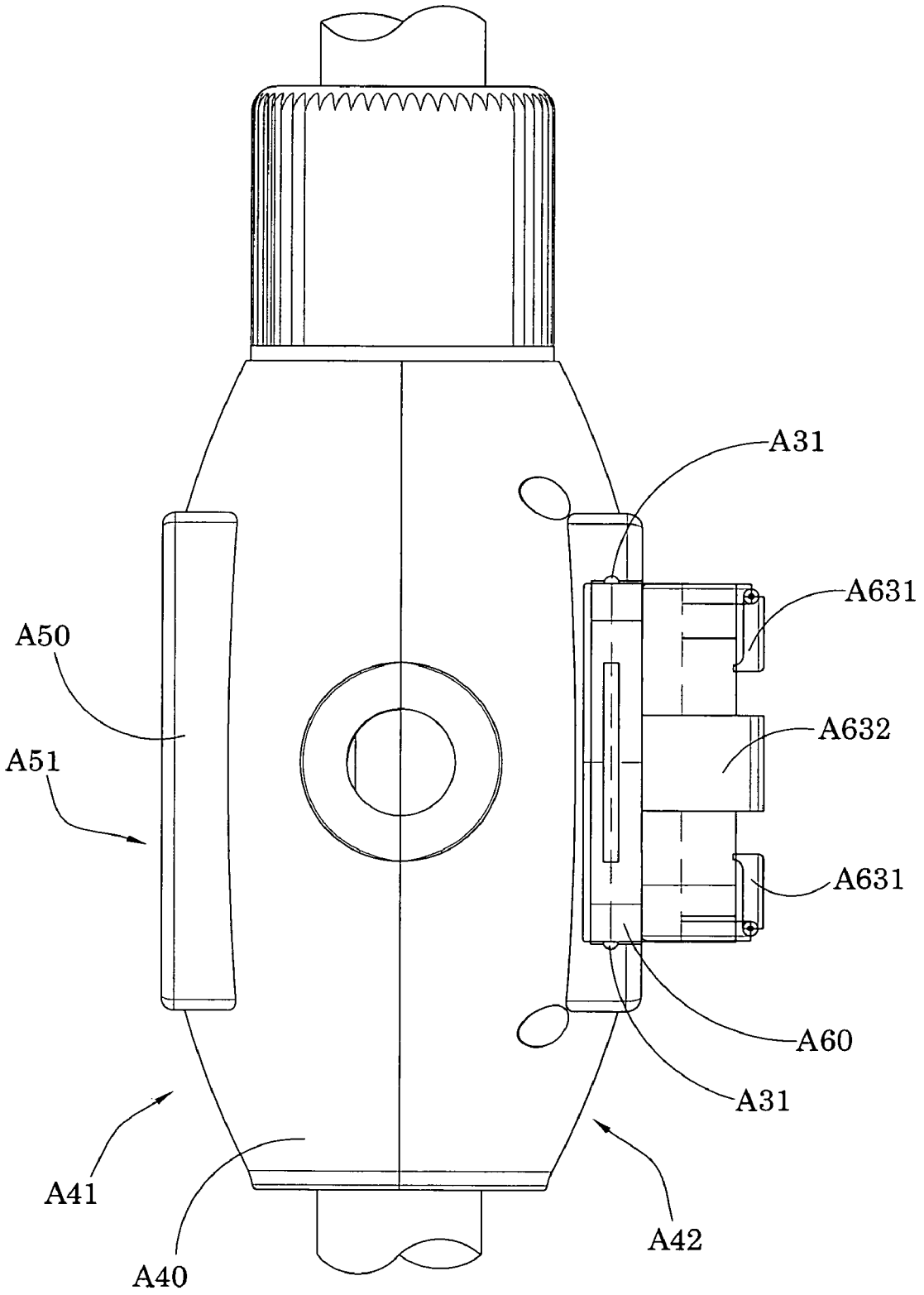
FIG. 13 is another side sectional view of the controller unit according to the above preferred embodiment of the present invention, illustrating the holding side of the electronic appliance holder facing outwardly and the retracting arms at a retracted position.

As shown in FIGS. 13 and 21, the control panel A40 further comprises a connecting terminal A45 operatively connecting to the electrical terminal 32 of the electrical arrangement 30 at the second receiving cavity A44. Therefore, when the control panel A40 is coupled at the first wall surface A41 of the operation housing A40, the connecting terminal A45 is connected to the electrical terminal 32 so as to enable the electrical arrangement 30 being operated by the control panel A40. It is appreciated that the control panel A40 can be controlled to wirelessly operate the electrical arrangement 30 as well.

In addition, the receiving cavity A43 and the second receiving cavity A44 can be configured as the battery compartment 27 such that the rechargeable power source 40 can be selectively coupled at one of the first and second wall surfaces A41, A42 of the operation housing A40 while either the control panel A40 or the electronic appliance holder 60 can be coupled at another wall surface A42, A41 of the operation housing A40. For example, when the rechargeable power source 40 is coupled at the first wall surface A41 of the operation housing A40 to electrically contact the battery terminal 43 with the electrical terminal 32 of the electrical arrangement 30 at the operation housing A40, and the electronic appliance holder 60 is coupled at the second wall surface A42 of the operation housing A40, the electronic appliance A20 held by the electronic appliance holder 60 can be electrically charged via the rechargeable power source 40 via any charging cable or the like. It is appreciated that the rechargeable battery unit 41 of the rechargeable power source 40 can be detachably coupled at the first wall surface A41 of the operation housing A40 via the same mechanism of the releasable interlocker A31 as an alternative of the releasable locker 46 as it is mentioned above. Therefore, the rechargeable power source 40, the control panel A50, and the electronic appliance holder 60 are formed as the detachable electronic arrangement for the outdoor shading device to selectively couple at the operation housing A40. In other words, the releasable interlocker 46, A31 is provided at a peripheral wall of the detachable electronic arrangement to releasably lock the detachable electronic arrangement within each of the receiving cavities A43, A44 of the operation housing A40.

As will be readily appreciated the controller unit A30 is arranged for universally and interchangeably receiving the above the rechargeable power source 40, the control panel A50, and the electronic appliance holder 60, in such a manner that the manufacturing process is, meanwhile, being simplified, so as to minimize the manufacturing cost. The interchangeable and detachably the rechargeable power source 40, the control panel A50, and the electronic appliance holder 60 also provides variety of combinations for the users selectively assembling the rechargeable power source 40, the control panel A50, and the electronic appliance holder 60 in accordance with their needs.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. An outdoor shading device, comprising:

an umbrella frame comprising a supporting shaft and an awning frame suspendedly supported by said supporting shaft and coupled with said umbrella awning for defining a shading area thereunder;

an umbrella awning supported by said umbrella frame to define a shading area under said umbrella awning;

an electrical arrangement supported at said umbrella frame for providing an additional umbrella function; and a controller unit, comprising:

an operation housing mounted on said supporting frame at a hand reachable location, wherein said operation housing has a first wall surface and a second wall surface; and a detachable electronic arrangement detachably coupling at each of said first and second wall surfaces of said operation housing to operatively link with said electrical arrangement, wherein said detachable electronic arrangement comprises a control panel detachably coupling at said first wall surface of said operation housing to operatively control said electrical arrangement, wherein said detachable electronic arrangement further comprises an electronic appliance holder detachably coupling at said second wall surface of said operation housing for holding at least an electronic appliance thereat, wherein said control panel is adapted for communicatively linking to said electronic appliance to selectively control an operation of said electronic appliance, wherein said electronic appliance holder has a storage side and an opposed holding side arranged in such a manner that when said storage side of said electronic appliance holder is engaged with said operation housing, said holding side of said electronic appliance holder faces outwardly for holding said electronic appliance in position, and when said holding side of said electronic appliance holder is engaged with said operation housing, said storage side of said electronic appliance holder is aligned with said second wall surface to house said electronic appliance holder at said operation housing.

2. The outdoor shading device, as recited in claim 1, wherein said control panel comprises a controller interface operatively controlling said electrical arrangement and a wireless communication link for communicatively linking with said electronic appliance in a wireless connection manner, so as to enable said controller interface being activated to control the operations of said electrical arrangement and said electronic appliance.

3. The outdoor shading device, as recited in claim 2, wherein said detachable electronic arrangement comprises a rechargeable battery unit detachably coupled at one of said first and second wall surfaces of said operation housing to electrically link to said electrical arrangement.

4. The outdoor shading device, as recited in claim 3, wherein said rechargeable battery unit has a battery terminal contacting with an electrical terminal of said electrical arrangement at said operation housing when said rechargeable battery unit is detachably coupled with said operation housing.

5. The outdoor shading device, as recited in claim 4, wherein said operation housing further has two receiving cavities indently formed at said first and second wall surfaces of said operation housing respectively to detachably receive said detachable electronic arrangement.

6. The outdoor shading device, as recited in claim 5, wherein said controller unit further comprises a releasable interlocker provided at a peripheral wall of said detachable electronic arrangement to releasably lock said detachable electronic arrangement within said receiving cavity of said operation housing.

7. The outdoor shading device, as recited in claim 4, further comprising an operational unit provided at said operation housing for controlling a folding operation of said awning between an unfolded position and a folded position, wherein said operational unit comprises an operation handle rotatably coupled at said operation housing between said first and second wall surfaces thereof to control the folding operation of said awning.

8. The outdoor shading device, as recited in claim 1, wherein said operation housing further has two receiving cavities indently formed at said first and second wall surfaces of said operation housing respectively to detachably receive said detachable electronic arrangement.

9. The outdoor shading device, as recited in claim 8, wherein said controller unit further comprises a releasable interlocker provided at a peripheral wall of said detachable electronic arrangement to releasably lock said detachable electronic arrangement within said receiving cavity of said operation housing.

10. An outdoor shading device, comprising:

an umbrella frame comprising a supporting shaft and an awning frame suspendedly supported by said supporting shaft and coupled with said umbrella awning for defining a shading area thereunder;

an umbrella awning supported by said umbrella frame to define a shading area under said umbrella awning;

an electrical arrangement supported at said umbrella frame for providing an additional umbrella function; and a controller unit, comprising:

an operation housing mounted on said supporting frame at a hand reachable location, wherein said operation housing has a first wall surface and a second wall surface; and a detachable electronic arrangement detachably coupling at each of said first and second wall surfaces of said operation housing to operatively link with said electrical arrangement, wherein said operation housing further has two receiving cavities indently formed at said first and second wall surfaces of said operation housing respectively to detachably receive said detachable electronic arrangement, wherein said controller unit further comprises a releasable interlocker provided at a peripheral wall of said detachable electronic arrangement to releasably lock said detachable electronic arrangement within said receiving cavity of said operation housing.

* * * * *